US011213179B2

(12) United States Patent
Conrad

(10) Patent No.: US 11,213,179 B2
(45) Date of Patent: Jan. 4, 2022

(54) BLEED VALVE SUCH AS FOR A SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 513 days.

(21) Appl. No.: 16/280,841

(22) Filed: Feb. 20, 2019

(65) Prior Publication Data

US 2020/0260927 A1 Aug. 20, 2020

(51) Int. Cl.

| | |
|---|---|
| ***A47L 9/28*** | (2006.01) |
| ***A47L 9/14*** | (2006.01) |
| ***A47L 9/16*** | (2006.01) |
| ***A47L 5/28*** | (2006.01) |

(52) U.S. Cl.

CPC ..... *A47L 9/2889* (2013.01); *A47L 5/28* (2013.01); *A47L 9/14* (2013.01); *A47L 9/1608* (2013.01)

(58) Field of Classification Search

CPC . A47L 9/2889; A47L 5/28; A47L 9/14; A47L 9/1608

See application file for complete search history.

(56) References Cited

U.S. PATENT DOCUMENTS 6,932,585 B2 8/2005 Na et al.
2015/0351596 A1* 12/2015 Thorne ..... A47L 5/225 15/332

FOREIGN PATENT DOCUMENTS

DE 202006017191 U1 2/2007
GB 845104 A 8/1960

OTHER PUBLICATIONS

English machine translation of DE202006017191, published on Feb. 8, 2007.

* cited by examiner

*Primary Examiner* — Andrew A Horton
(74) *Attorney, Agent, or Firm* — Philip C. Mendes da Costa; Bereskinn & Parr LLP/S.E.N.C.R.L., s.r.l

(57) ABSTRACT

A bleed valve is selectively opened and closed due to a pressure differential between across an arcuate spring member.

20 Claims, 21 Drawing Sheets

BLEED VALVE SUCH AS FOR A SURFACE CLEANING APPARATUS

FIELD

This disclosure relates generally to bleed valves and a surface cleaning apparatus having the bleed valve.

INTRODUCTION

The following is not an admission that anything discussed below is part of the prior art or part of the common general knowledge of a person skilled in the art.

Various types of surface cleaning apparatus are known. Such surface cleaning apparatus include vacuum cleaners, including upright vacuum cleaners, hand carryable vacuum cleaners, canister-type vacuum cleaners, extractors and wet/dry type vacuum cleaners (e.g. Shop-Vac™). Some vacuum cleaners include a cyclonic separator (also referred to as a cyclone bin assembly) having a cyclone chamber and a dirt collection chamber. A suction motor is used to draw air through the surface cleaning apparatus. A filter, such as a pre-motor filter, may be provided in the airflow path through the surface cleaning apparatus.

The air flow through a surface cleaning apparatus is typically used to cool the suction motor. As the air flow path upstream of the suction motor becomes partially blocked, the rate of air flow to the suction motor may be reduced, thereby reducing the cooling provided to the suction motor. As some point, the suction motor may overheat and become damaged due to overheating. To prevent such overheating, a bleed valve may be provided to provide exterior air to supplement the air reaching the suction motor through air flow path upstream of the suction motor.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In one aspect, a bleed valve is provided which is operable between two configurations, each of which is arcuate. An advantage of such a design is that the valve member itself is only stable in two positions and therefore is only moveable between a fully closed position and a fully open position. A further advantage is that the valve member moves rapidly from the fully closed position to the fully open position when a reduction in air flow that may cause overheating occurs.

In accordance with this aspect, there is provided a surface cleaning apparatus having:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising an arcuate spring member operable between a closed configuration in which the spring member is in a closed arcuate configuration and abuts the opening, and an open arcuate configuration in which the spring member is in an open arcuate configuration and is spaced from the opening.

In some embodiments, the arcuate spring member may be positionable in only the closed arcuate configuration and the open arcuate configuration.

In some embodiments, the arcuate spring member may be biased to the closed arcuate configuration.

In some embodiments, the arcuate spring member may be positioned interior to the bleed air inlet.

In some embodiments, the arcuate spring member may be provided in a bleed valve housing and the arcuate spring member may be in the closed arcuate configuration prior to being installed in the bleed valve housing.

In some embodiments, the arcuate spring member may be pre-formed in an arcuate shape.

In some embodiments, the arcuate spring member may be provided in a bleed valve housing and the bleed valve housing may deform the arcuate spring member into the closed arcuate configuration.

In some embodiments, the wall of the surface cleaning apparatus may be an outer wall of the airflow path and the arcuate spring member may be located in the airflow path.

In some embodiments, the bleed valve may have a plurality of arcuate spring members overlying each other.

In some embodiments, the bleed valve may have two arcuate spring members that abut each other.

In some embodiments, the surface cleaning apparatus may have a sealing member located between the arcuate spring member and the wall when the arcuate spring member is in the closed arcuate configuration.

In another aspect, a bleed valve uses two or more cantilevered spring members as the valve members. An advantage of this design is that the use of two cantilevered spring members enables the bleed valve to more securely close the bleed valve inlet port while enabling the valve to open at a desired (pre-determined) pressure differential.

In accordance with this aspect, there is provided a surface cleaning apparatus having:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising at least first and second abutting cantilevered spring members operable between a closed configuration in which the first spring member abuts the opening, and an open arcuate configuration in which the first and second spring members are in a curved configuration and are spaced from the opening.

In some embodiments, when in the closed configuration, the spring members may be generally planar.

In some embodiments, the second spring member may be located on an inner side of the first spring member and is shorter than the first spring member.

In some embodiments, the surface cleaning may have a sealing member located between the first spring member and the wall when the first spring member is in the closed configuration.

In some embodiments, the sealing member may be provided on an inner surface of the wall.

In some embodiments, the sealing member may be provided on the first spring member.

In some embodiments, the sealing member may encase at least a portion of the first spring member.

In another aspect, a cantilevered spring member is provided with a sealing member, such as a gasket. The sealing member is positioned between the cantilevered spring member and a housing surrounding the inlet port of the bleed valve when the cantilevered spring member is in the closed position. Accordingly, the sealing member travels with the cantilevered spring member.

In accordance with this aspect, there is provided a surface cleaning apparatus having:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising a cantilevered spring member operable between a closed configuration in which the spring member abuts the opening, and an open arcuate configuration in which the spring member is in a curved configuration and is spaced from the opening, wherein a sealing member encases at least a portion of the spring member.

These and other aspects and features of various embodiments will be described in greater detail below.

DRAWINGS

For a better understanding of the described embodiments and to show more clearly how they may be carried into effect, reference will now be made, by way of example, to the accompanying drawings in which.

Figure 12:
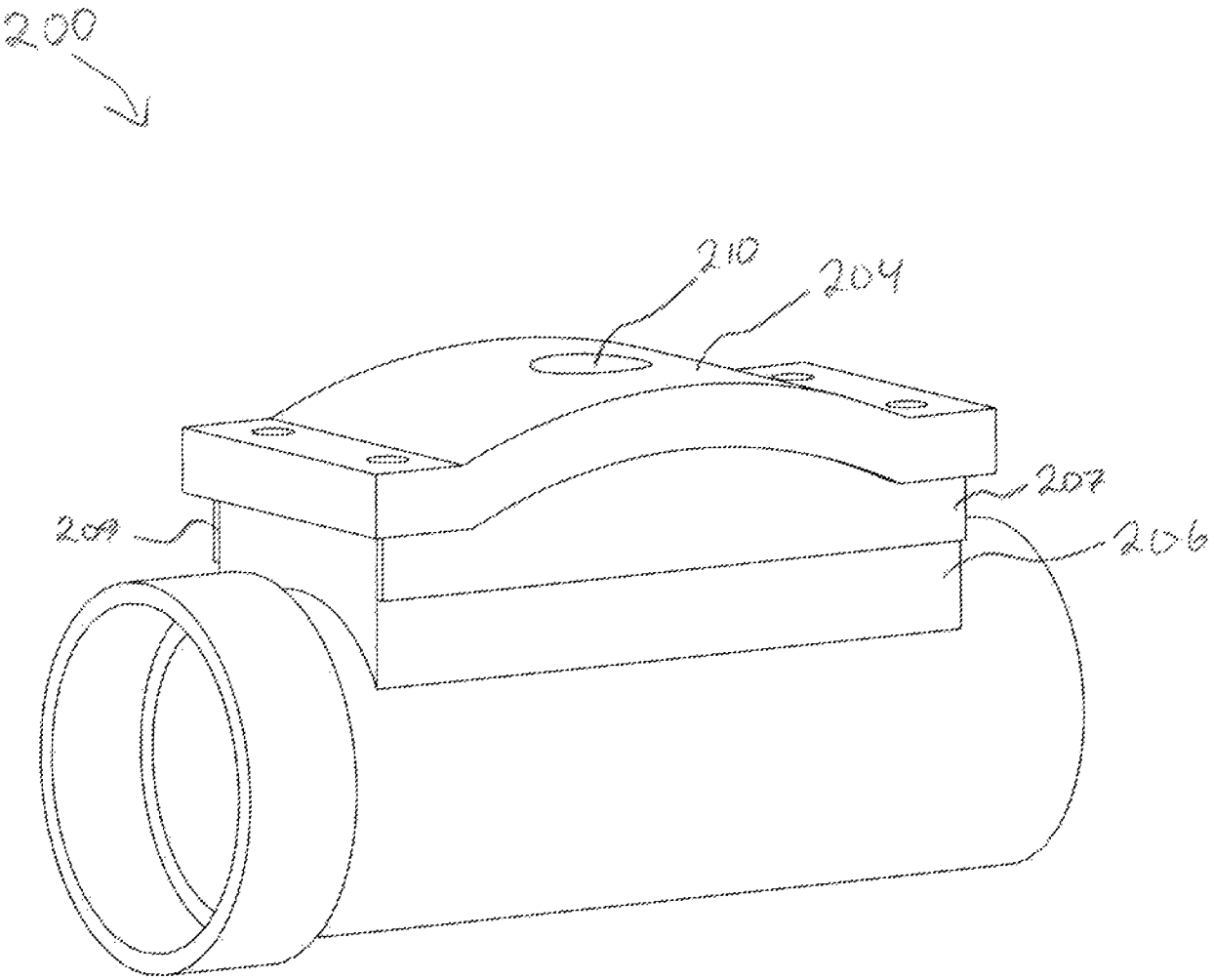
Figure 13:
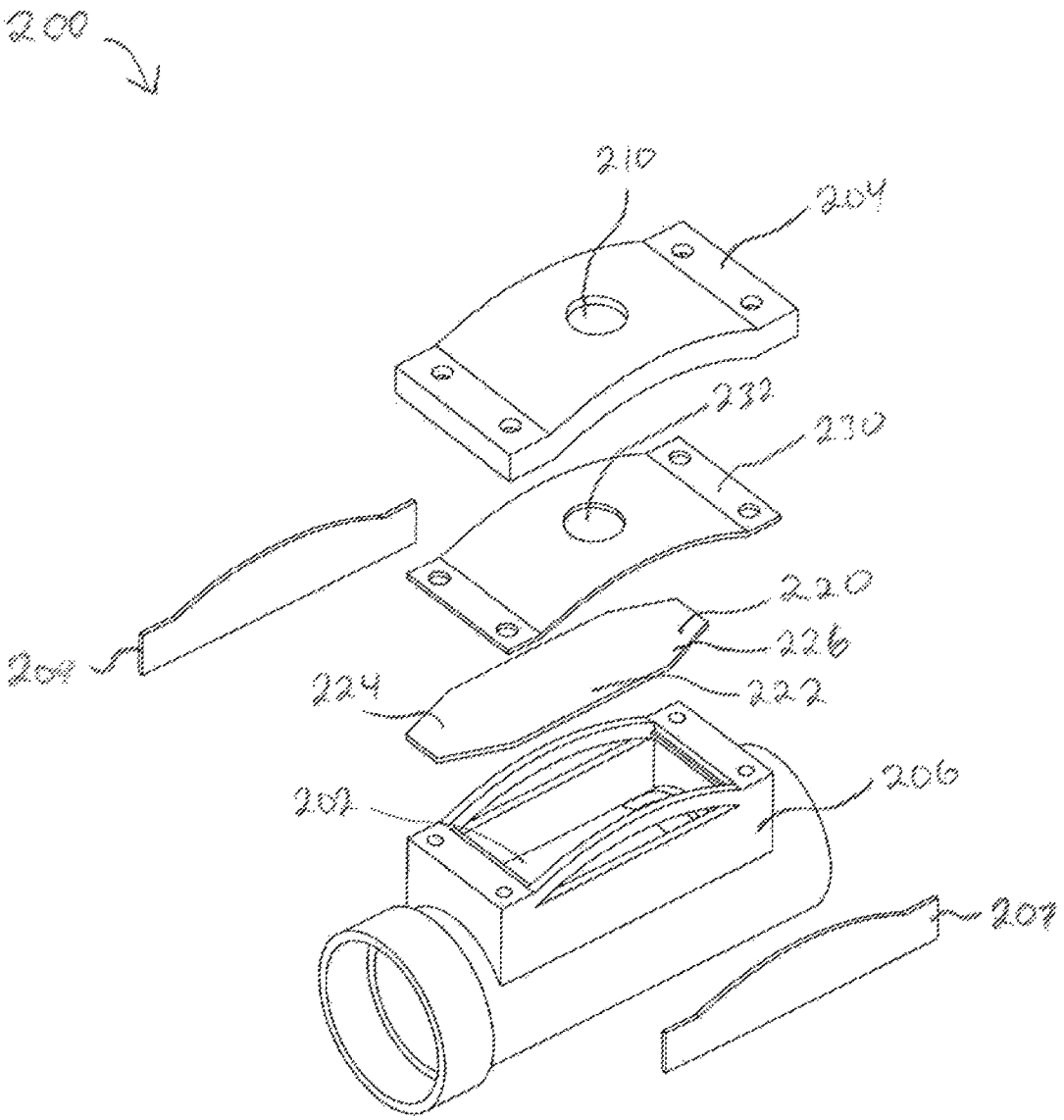
Figure 14:
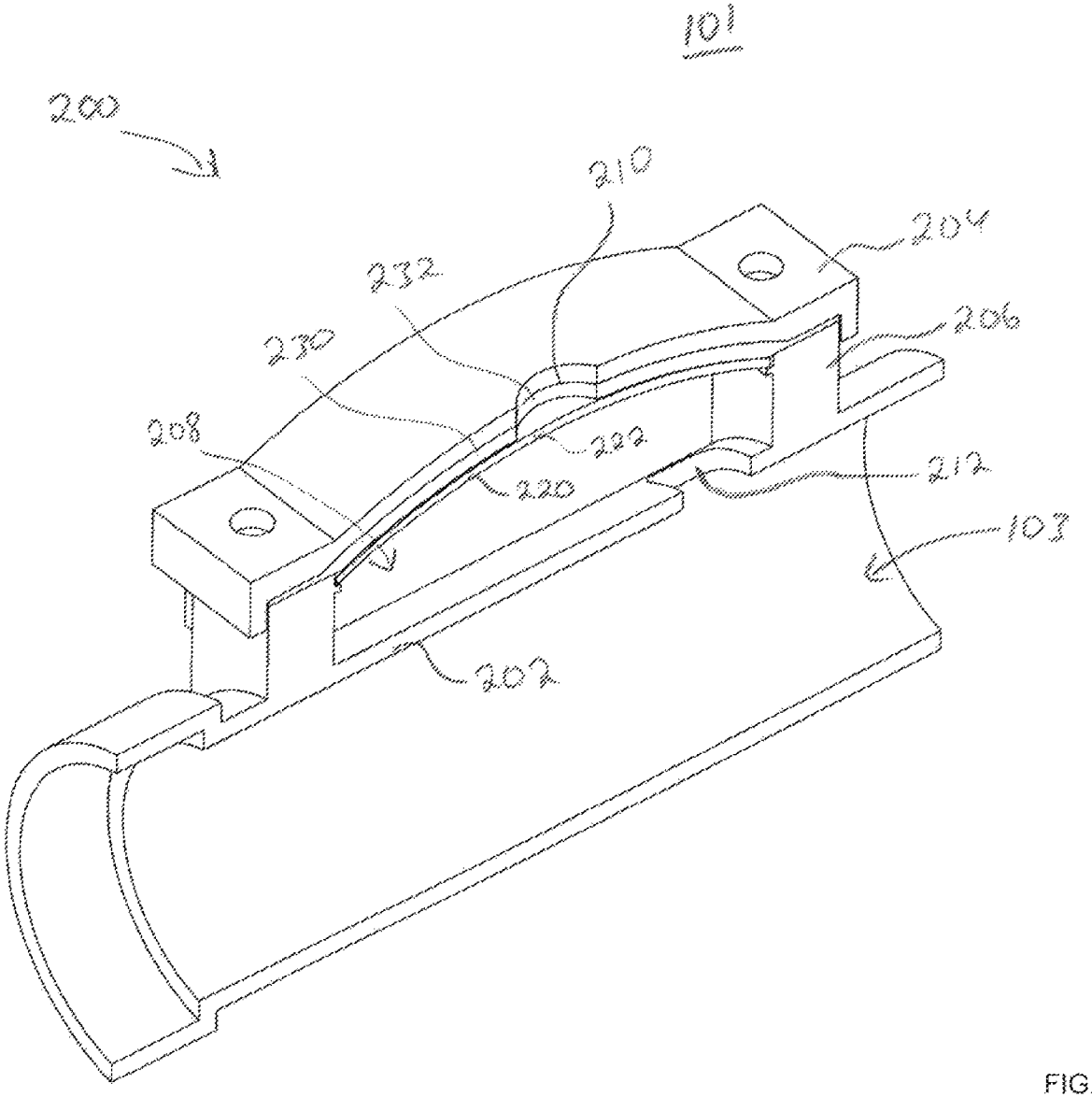
Figure 15:
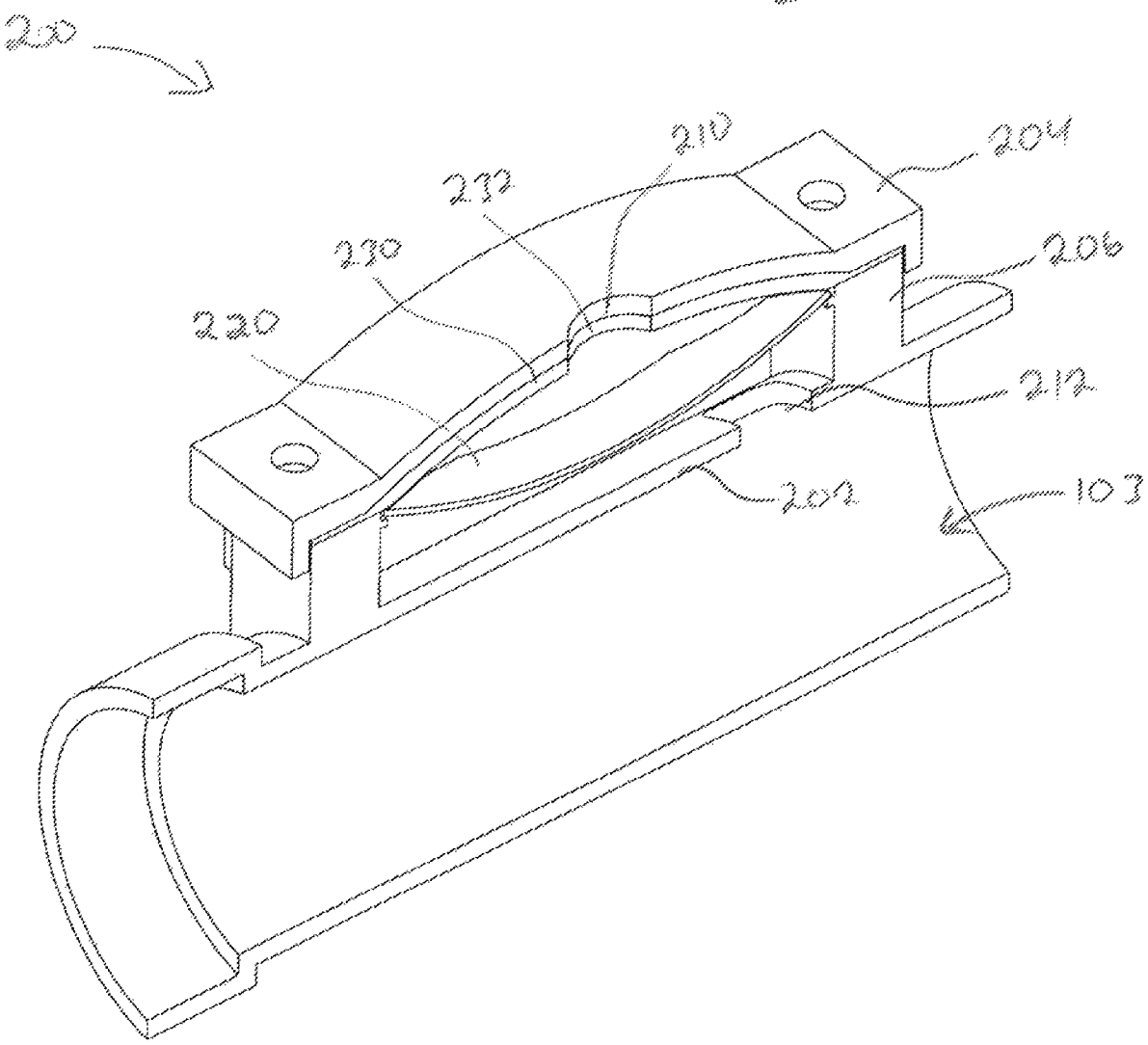
Figure 16:
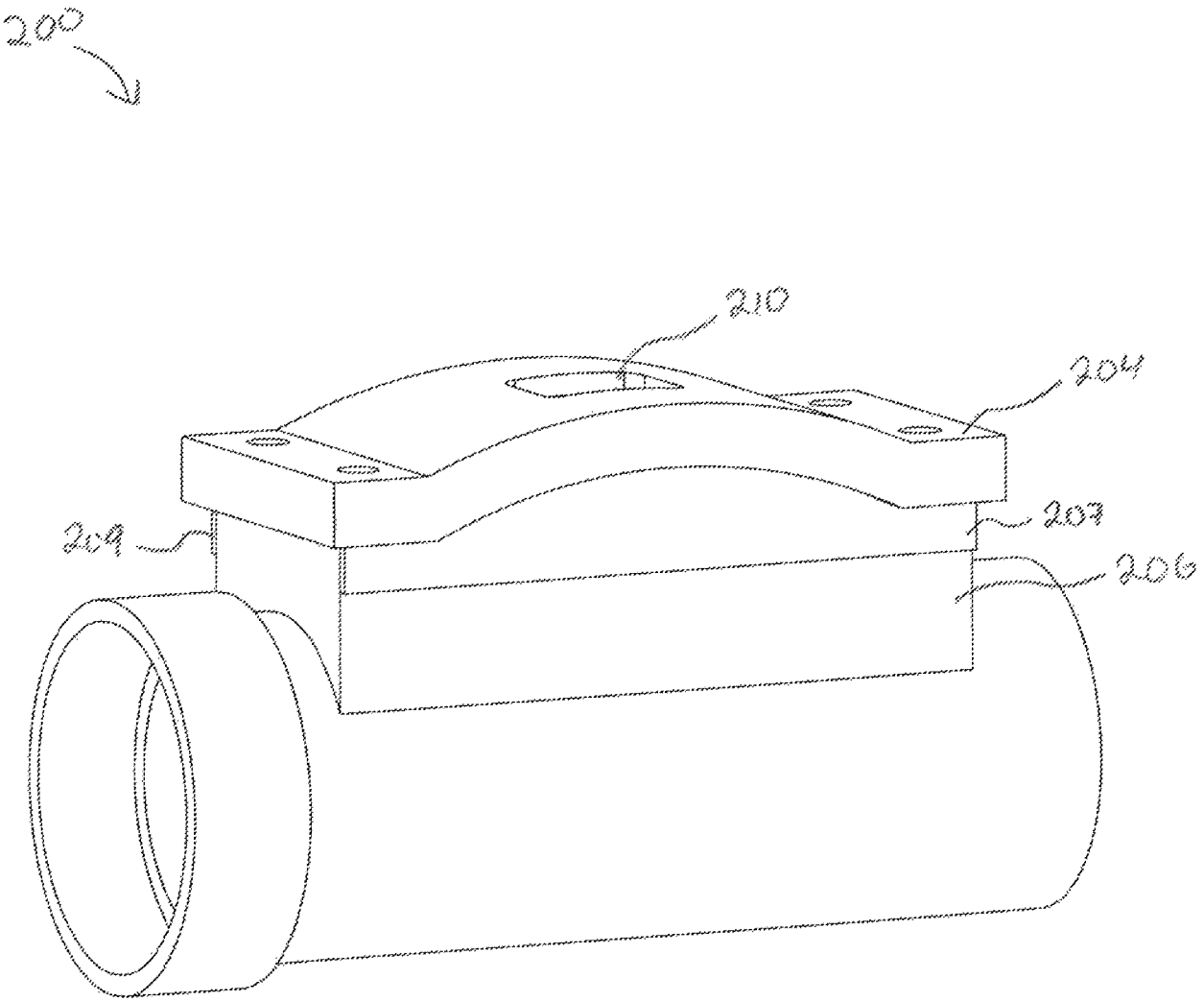

FIG. 12 a perspective view of a bleed valve in accordance with another embodiment;

FIG. 13 is an exploded view of the bleed valve of FIG. 12;

FIG. 14 is a perspective sectional view of the bleed valve of FIG. 12 with the bleed valve in a closed position;

FIG. 15 is a perspective sectional view of the bleed valve of FIG. 12 with the bleed valve in an open position;

FIG. 16 is a perspective view of a bleed valve in accordance with another embodiment.

Figure 17:
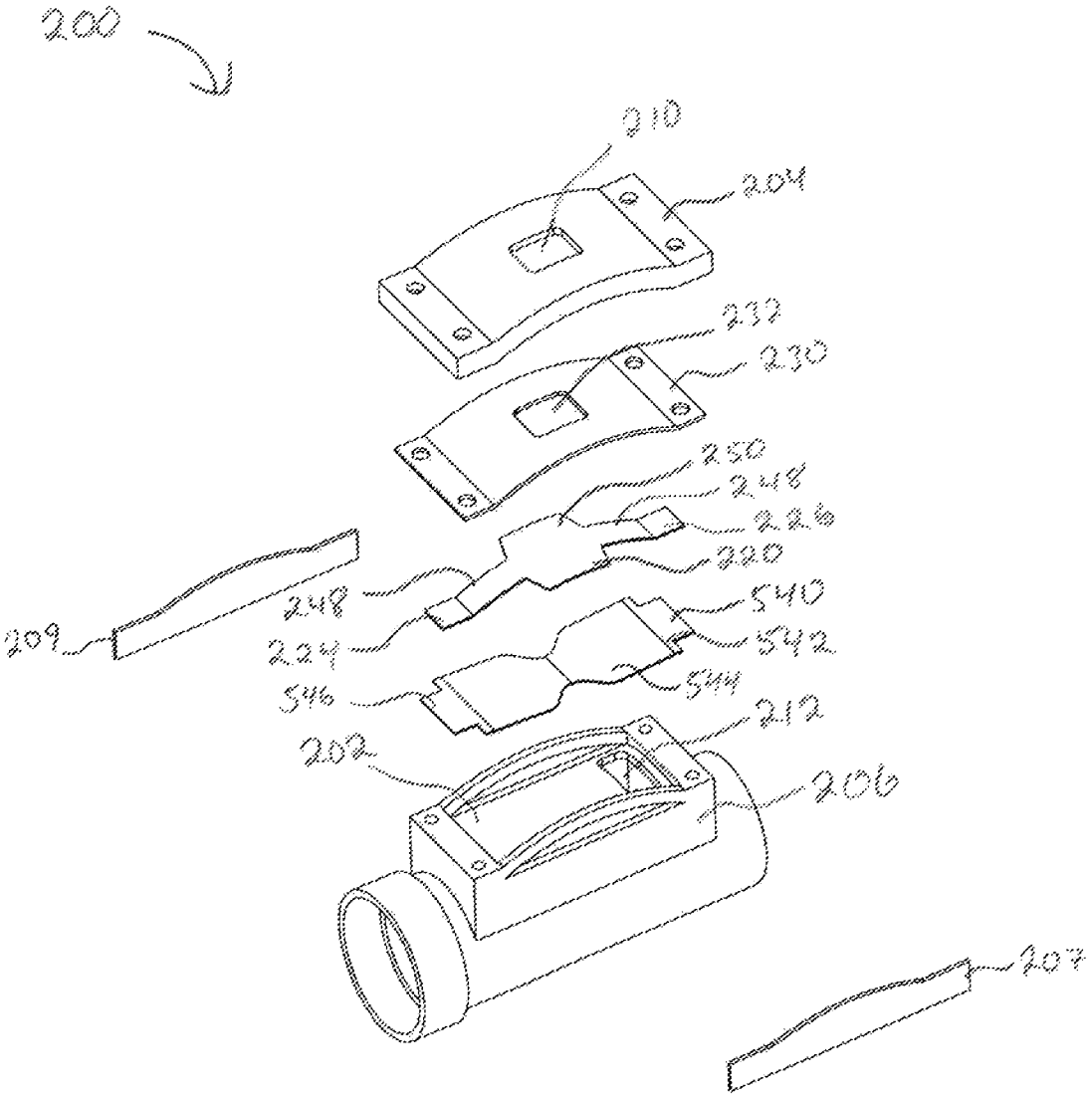
Figure 18:
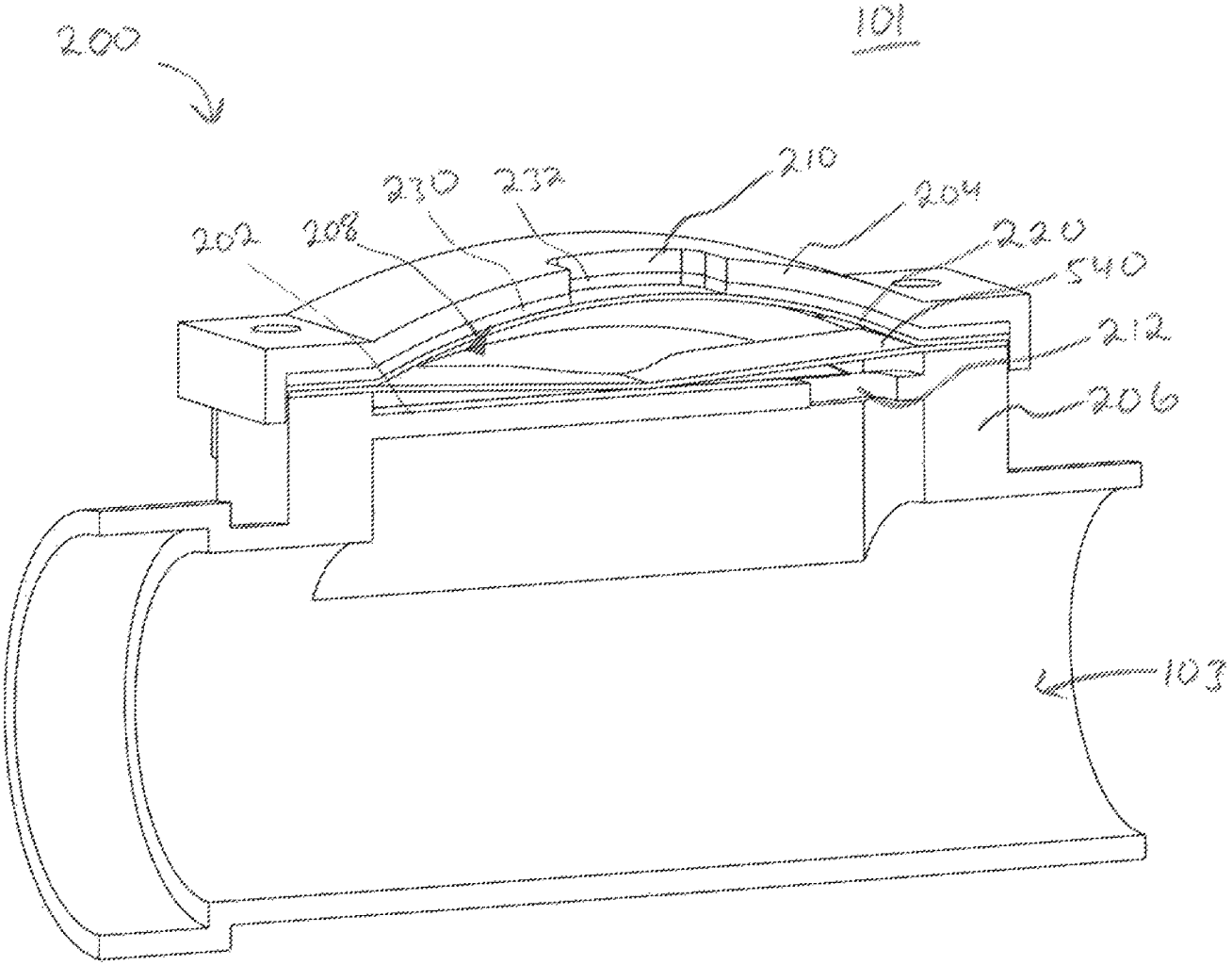
Figure 19:
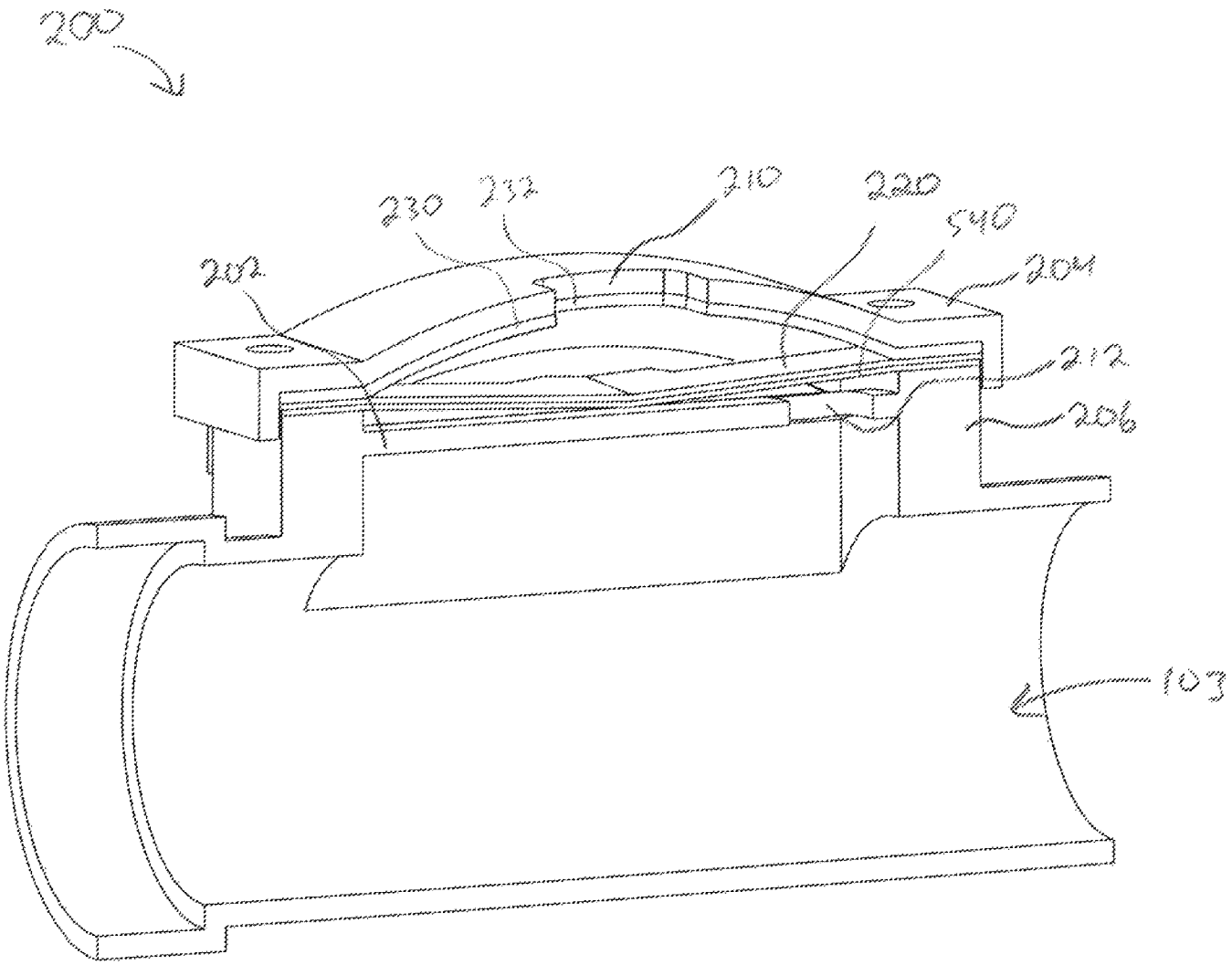
Figure 20:
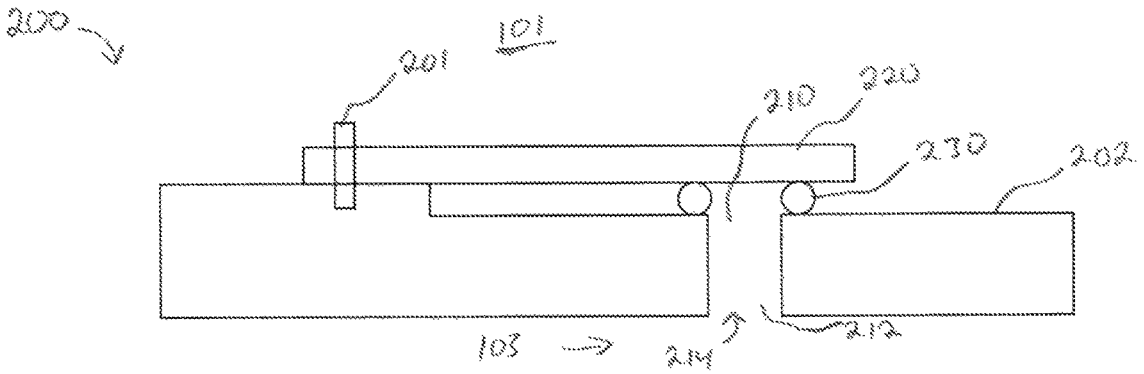
Figure 21:
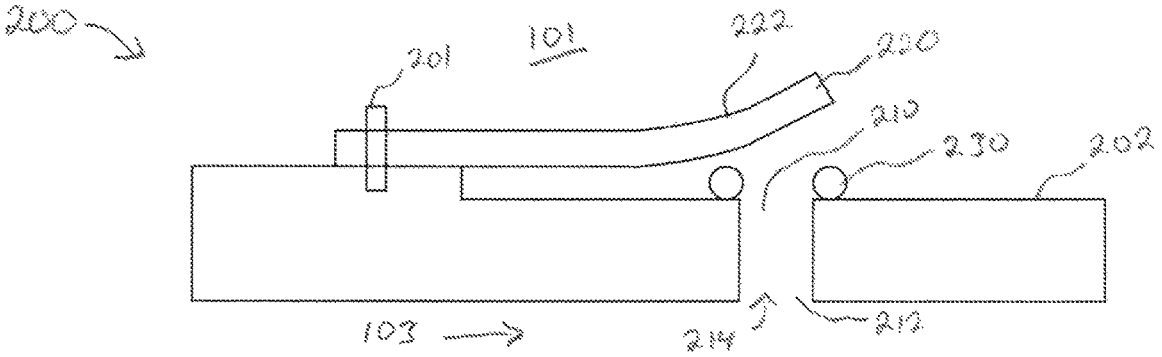
Figure 22:
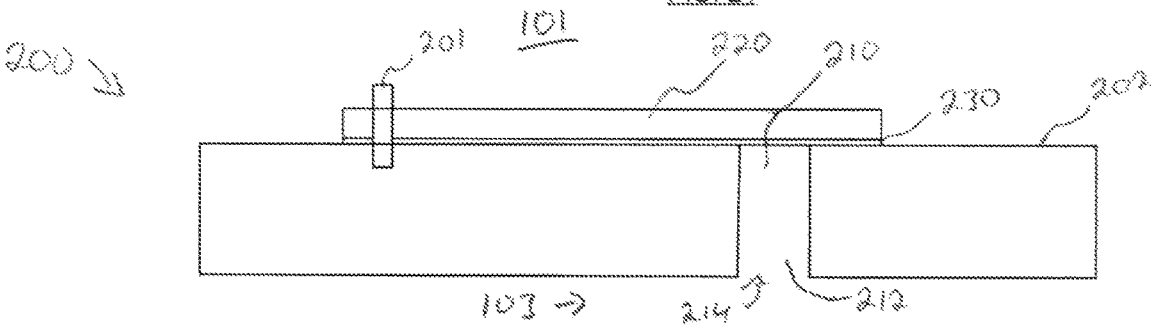
Figure 23:
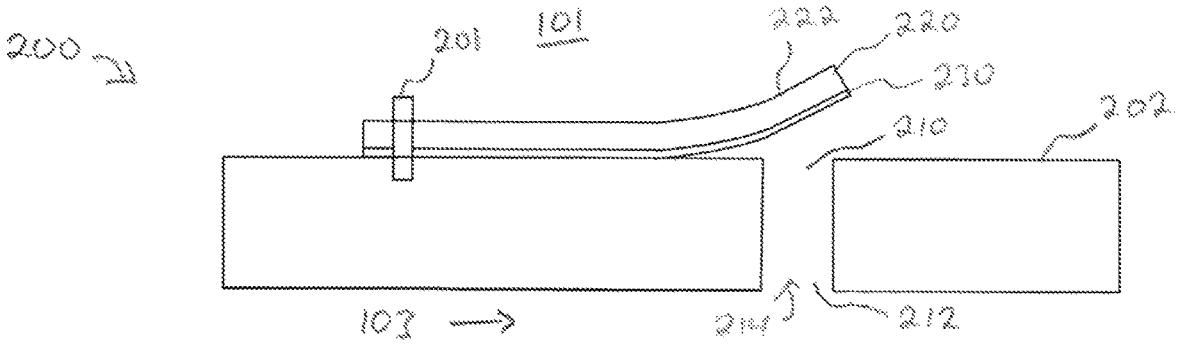
Figure 24:
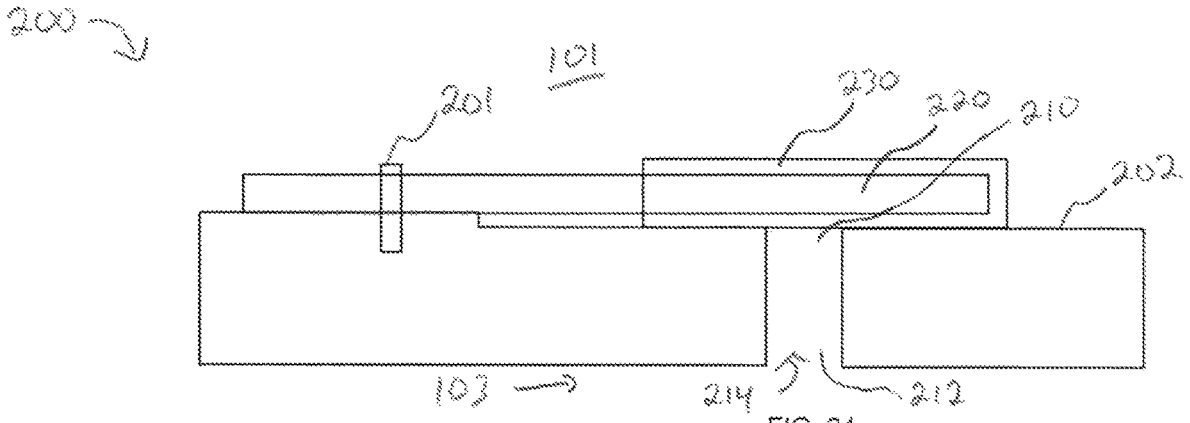
Figure 25:
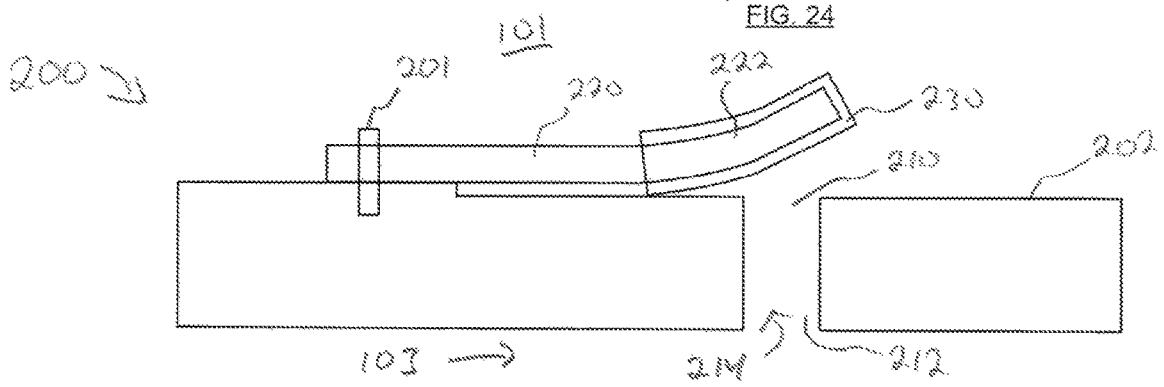
Figure 26:
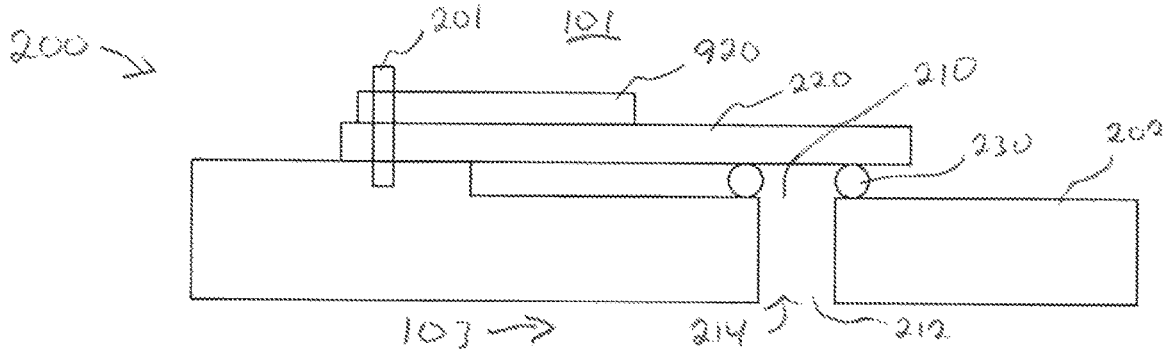
Figure 27:
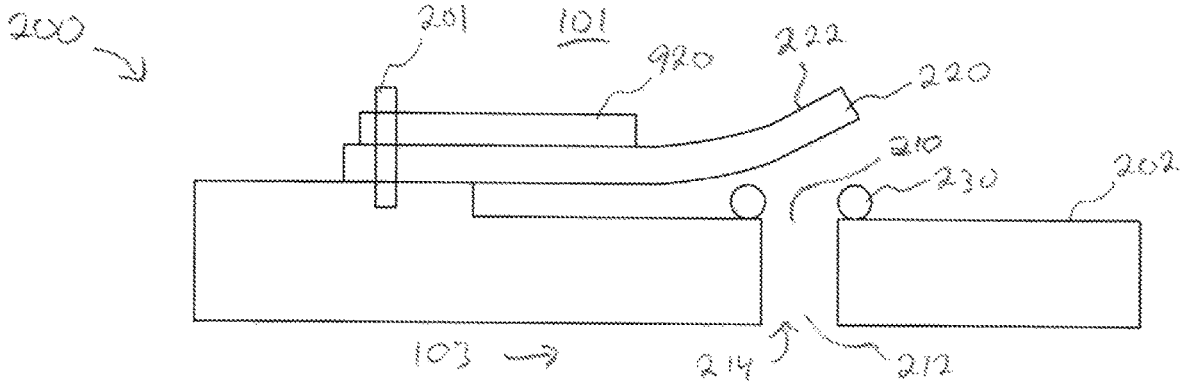

FIG. 17 is an exploded view of the bleed valve of FIG. 16;

FIG. 18 is a perspective sectional view of the bleed valve of FIG. 16 with the bleed valve in a closed position;

FIG. 19 is a perspective sectional view of the bleed valve of FIG. 17 with the bleed valve in an open position;

FIGS. 20 and 21 show side views of a bleed valve in accordance with another embodiment, wherein the bleed valve is in the closed and open positions respectively;

FIGS. 22 and 23 show side views of a bleed valve in accordance with another embodiment, wherein the bleed valve is in the closed and open positions respectively;

FIGS. 24 and 25 show side views of a bleed valve in accordance with another embodiment, wherein the bleed valve is in the closed and open positions respectively; and, FIGS. 26 and 27 show side views of a bleed valve in accordance with another embodiment, wherein the bleed valve is in the closed and open positions respectively.

DESCRIPTION OF VARIOUS EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined", "affixed", or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", "directly affixed", or "directly fastened" where the parts are connected in physical contact with each other. As used herein, two or more parts are said to be "rigidly coupled", "rigidly connected", "rigidly attached", "rigidly joined", "rigidly affixed", or "rigidly fastened" where the parts are coupled so as to move as one while maintaining a constant orientation relative to each other. None of the terms "coupled", "connected", "attached", "joined", "affixed", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. In addition, the description is not to be considered as limiting the scope of the example embodiments described herein.

General Description of a Vacuum Cleaner

Figure 1:
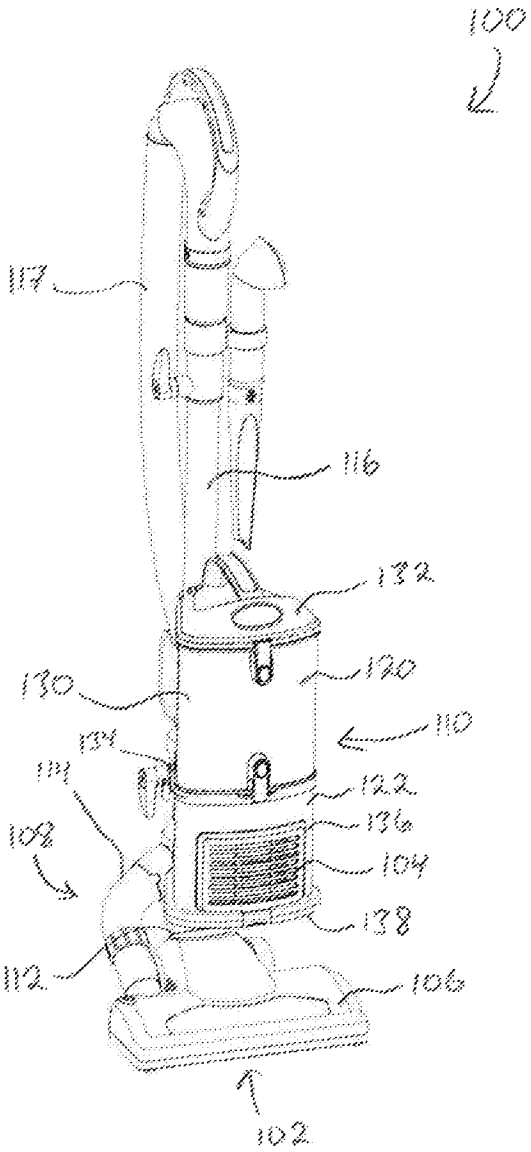
FIG. 1 is a perspective view of a surface cleaning apparatus which may use the bleed valve disclosed herein.
Figure 2:
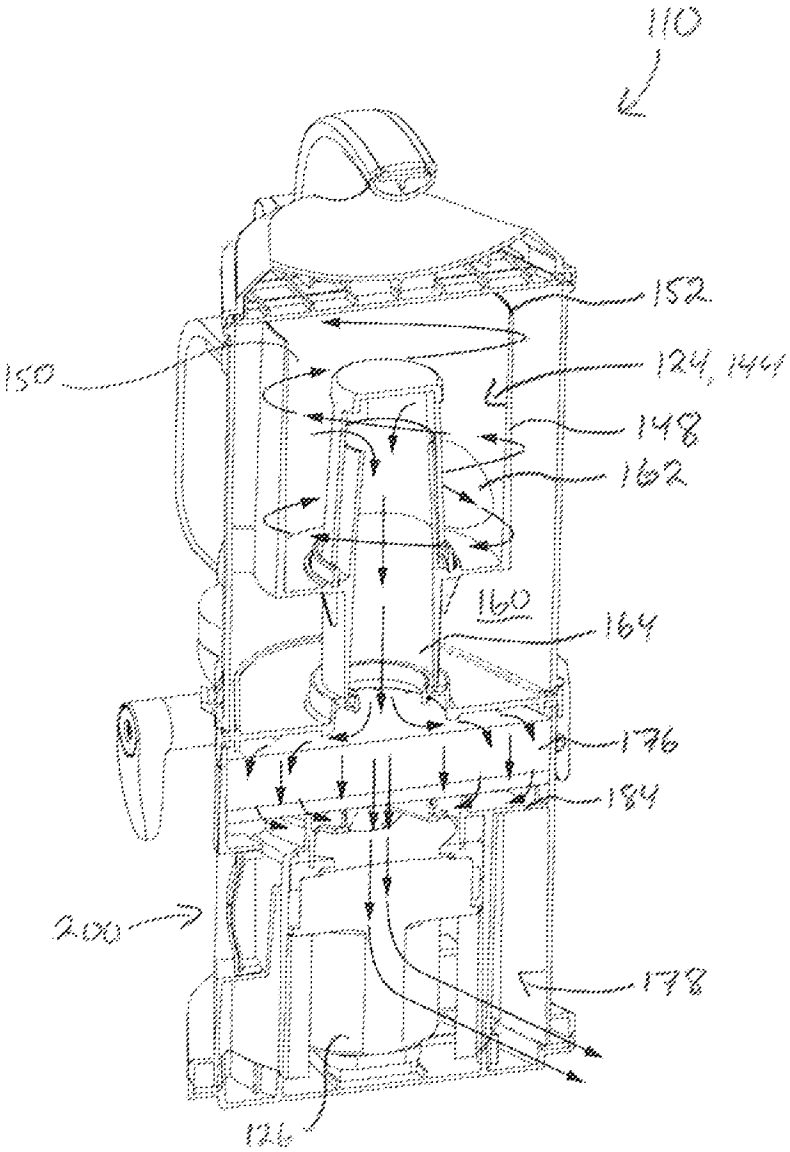
FIG. 2 is a cross-sectional view of a filtration unit of the surface cleaning apparatus of FIG. 1 with the bleed valve in a closed position.
Figure 3:
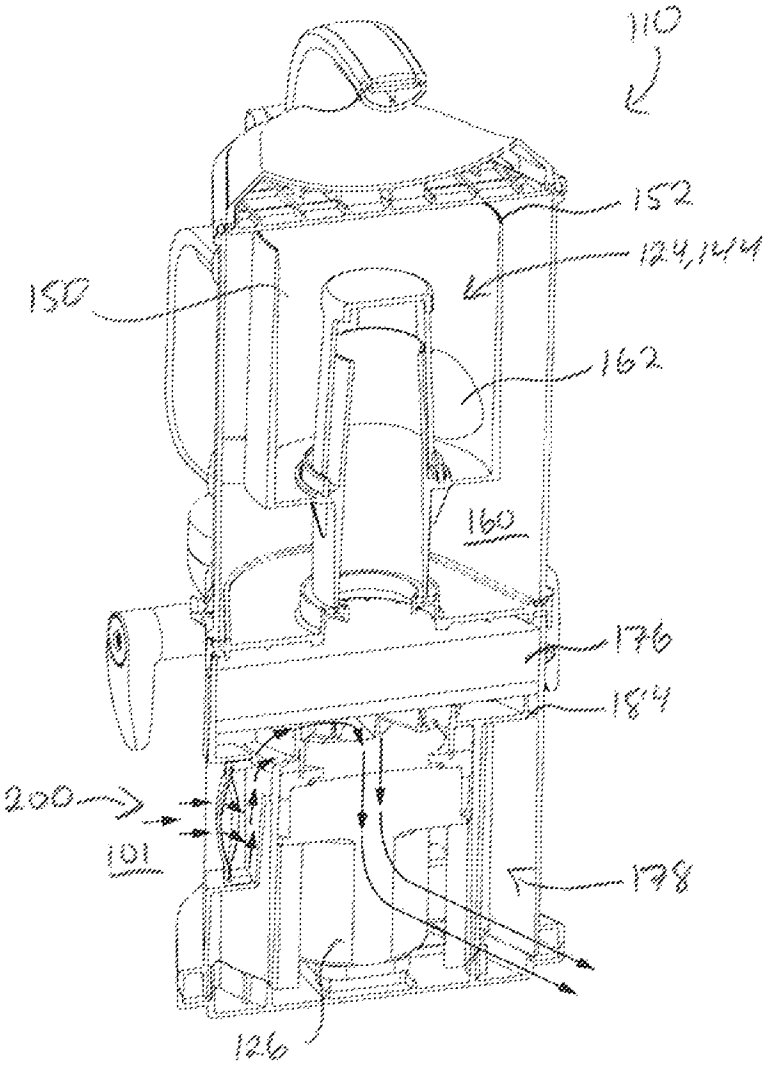
FIG. 3 is a cross-sectional view of a filtration unit of the surface cleaning apparatus of FIG. 1 with the bleed valve in an open position.
Figure 4:
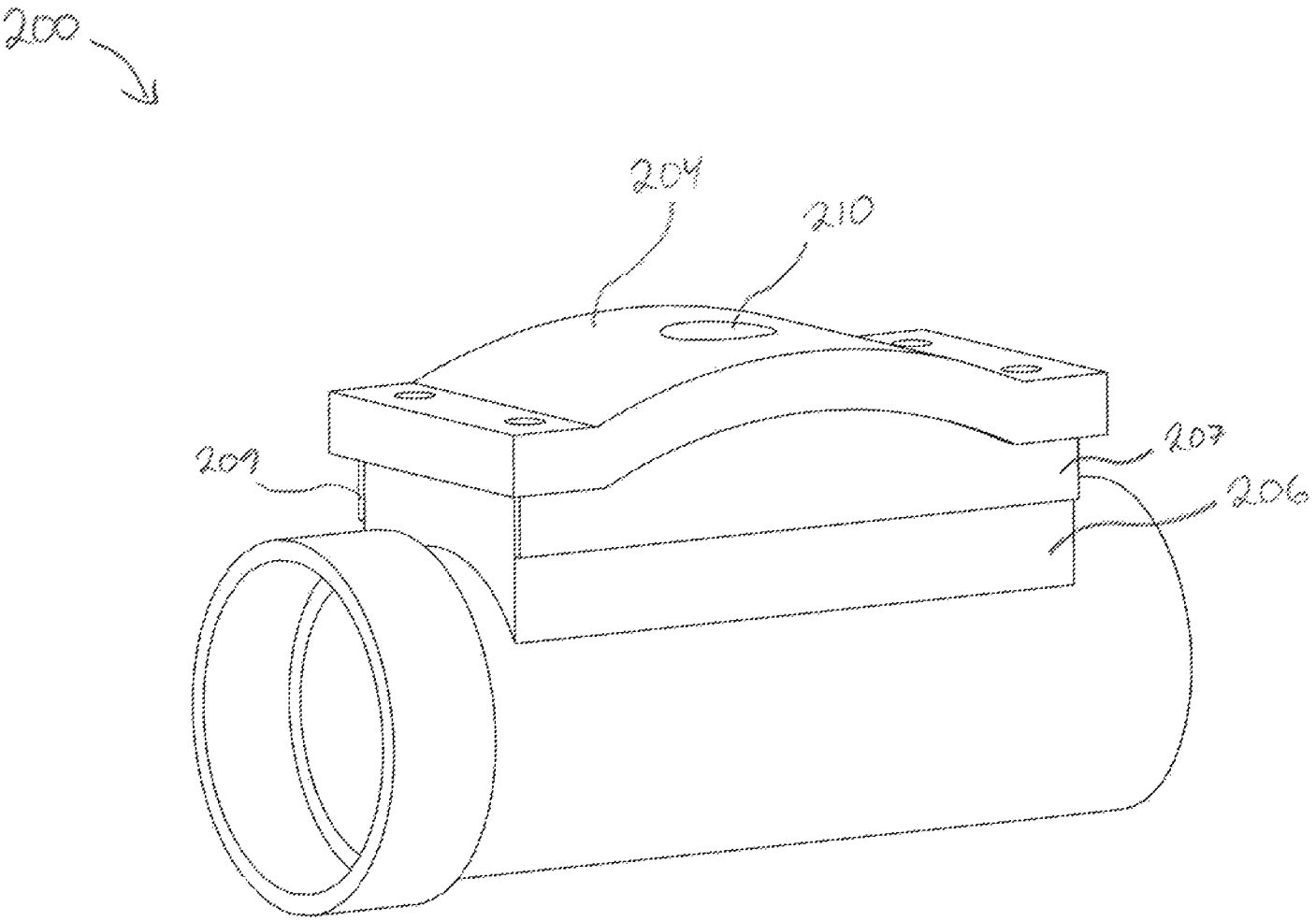
FIG. 4 is a perspective view of a bleed valve in accordance with another embodiment.
Figure 5:
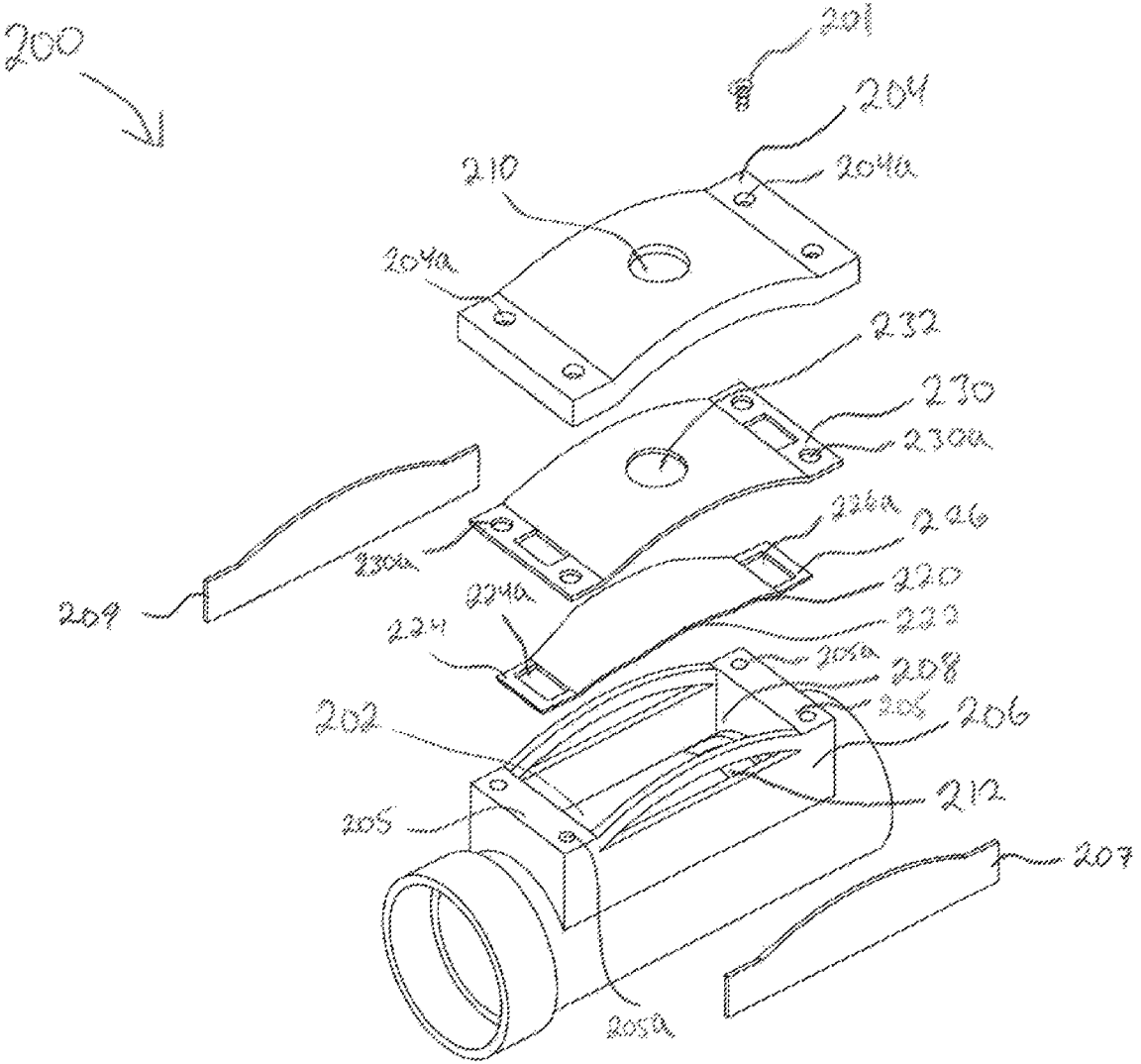
FIG. 5 is an exploded view of the bleed valve of FIG. 4.

FIGS. 1 to 3 show an exemplary embodiment of a surface cleaning apparatus 100 that may use one or more aspects of a bleed valve that are disclosed herein. The following is a general discussion of apparatus 100, which provides a basis for understanding several of the features discussed herein. As discussed subsequently, each of the features may be used individually or in any particular combination or sub-combination in this or in other embodiments disclosed herein.

Surface cleaning apparatus 100 may be any type of surface cleaning apparatus including, for example, a hand vacuum cleaner, a stick vacuum cleaner, an upright vacuum cleaner (as shown), a canister vacuum cleaner, an extractor, or a wet/dry type vacuum cleaner. In the embodiment shown, the surface cleaning apparatus 100 is an upright vacuum cleaner. Optionally, the surface cleaning apparatus may use one or more cyclones and may therefore be a cyclonic surface cleaning apparatus.

As exemplified in FIG. 1, the surface cleaning apparatus 100 has a dirty air inlet 102, a clean air outlet 104, and an airflow passage extending therebetween. The airflow passage has an interior 103 and a direction of flow from the dirty air inlet 102 to the clean air outlet 104. In the embodiment shown, the dirty air inlet 102 is provided in a lower surface of a surface cleaning head 106. From the dirty air inlet 102, an airflow passage extends through the surface cleaning head 106, and through an air conduit 108, to a suction and filtration unit 110. The suction and filtration unit 110 is provided on an upper section that is pivotally mounted to the surface cleaning head 106 by a pivoting joint member 112. The suction and filtration unit 110 includes a filtration member housing 120 and a suction motor housing 122. The clean air outlet 104 is provided in the suction and filtration unit 110. In the embodiment shown, the air conduit 108 includes a lower up flow duct 114, an upper up flow duct 116, a hose 117, and an elbow joint (not shown). The elbow joint is in airflow communication with the suction and filtration unit 110. In alternate embodiments, the air conduit 108 may be of another configuration. For example, only a pivoting joint member 112 and a lower up flow duct 114 may be provided.

Referring now to FIG. 2, the filtration member housing 120 houses a filtration member 124, or air treatment member 124, which is positioned in the airflow passage downstream of the dirty air inlet 102 for removing particulate matter from air flowing through the airflow passage. The suction motor housing 122 houses a suction motor 126, which is provided in the airflow passage downstream of the filtration member 124 for drawing air through the airflow passage.

As exemplified in FIG. 1, the filtration member housing 120 includes a sidewall 130, a top wall 132, and a bottom wall 134. The suction motor housing 122 includes a sidewall 136 and a bottom wall 138. Referring still to FIG. 2, in the embodiment shown, the filtration member 124 is a cyclone 144. In alternate embodiments, the filtration member 124 may be, for example, a filter, such as a filter bag or a foam filter. In further alternate embodiments, the filtration member 124 may include a plurality of cyclones, or a plurality of cyclonic stages.

In use, air flows from the hose 117 into a cyclone chamber 150 through a cyclone air inlet 162. In the cyclone chamber 150, the air flows within a cyclone wall 148 in a cyclonic pattern, and particulate matter is separated from the air. The particulate matter exits the cyclone chamber 150 through a first end 152, and settles in a dirt collection chamber 160. The air exits the cyclone chamber 150 through a cyclone air outlet 164, and enters the suction motor housing 122.

Referring again to FIG. 2, the suction motor housing 122 houses the suction motor 126, an optional pre-motor filter 176 upstream of the suction motor 126 and downstream of the cyclone 144, and an optional post-motor filter (not shown) downstream of the suction motor 126 and upstream of the clean air outlet 104 in a post-motor filter region 178. The suction motor 126 is housed within the suction motor housing 122 beneath an apertured support wall 184. The suction motor 126 may be any suitable type of suction motor.

It will be appreciated that the various elements discussed herein are for reference for the discussion of the specific exemplified embodiments and that the elements such as the cleaning head, the filtration and cleaning unit, the upper section and the like may be of various constructions known in the art. It will also be appreciated that some elements that are discussed are optional and need not be in any particular embodiment.

It is possible that in some instances, the airflow passage through the surface cleaning apparatus may become fully or partially clogged. For example, a large object, such as a ball of hair or popcorn, may become lodged anywhere in the airflow passage, such as in the surface cleaning head 106. Alternately, or in addition, the pre-motor filter 176 may become partially or fully clogged with particulate matter. For example, over time, the upstream surface of the pre-motor filter can become clogged upon collecting a threshold amount of dirt from the airflow passing through the surface cleaning apparatus. When the upstream surface is clogged, the collected dirt may create substantial impedance to airflow entering the filter member. If clogging occurs, the suction motor 126 may overheat and may burn out.

Accordingly, a bleed valve 200 may be provided to deliver exterior air to the air flow path through the vacuum cleaner. The bleed air may be introduced at various locations. If a pre-motor filter is provided, then the bleed air is optionally introduced downstream of the pre-motor filter and upstream of the suction motor. Accordingly, as exemplified in FIG. 2, the bleed valve 200 may be provided in the suction motor housing 122. If a clog occurs in the airflow passage, the pressure in the suction motor housing 122 will decrease. The bleed valve 200 is preferably configured to open when the pressure decreases to a particular pre-determined level so as to allow exterior air to flow into the suction motor housing 122 so that the suction motor 126 does not overheat.

Description of Arcuate Bleed Valve Embodiments

In one aspect, as exemplified in FIGS. 4 to 19, the bleed valve has one or more spring members, each of which is operable between an open configuration and a closed configuration, wherein, in each configuration, the spring member is arcuate or has an arcuate portion. The spring member may be shaped into an arcuate shape by the bleed valve housing, or the spring member may be pre-shaped into an arcuate shape prior to being installed in the bleed valve housing.

FIGS. 4 to 9 exemplify an example embodiment of a bleed valve 200. The bleed valve comprises a housing that defines a chamber 208 that extends between a bleed valve air inlet 210 and a bleed valve air outlet 212 and includes a valve member 220. The housing may be of various designs and part or all of the housing may for part of a surface cleaning apparatus 100, e.g., part of the motor housing. As exemplified, the bleed valve housing has an inner wall 202, an outer wall 204, end walls 205 and a sidewall 206 extending between the inner wall 202 and the outer wall 204 and between the end walls 205. The sidewall 206 also includes a first side panel 207 and a second side panel 209 to close the sidewalls. The inner wall 202 may be an outer wall of the airflow path. For example, the inner wall 202 may be a wall of the motor housing 122.

An airflow passageway 214 extends between air inlet 210 and air outlet 212. The air inlet 210 may be an opening provided centrally in the outer wall 204 or at any other location in the outer wall. The air outlet 212 may be an opening in the inner wall 202 and may be located at any location. As exemplified, the air outlet is provided adjacent one of the end walls 205. The airflow passageway 214 extends between a location 101 exterior to the airflow path (e.g., the ambient exterior to apparatus 100) and the interior of the airflow path 103. The portion of the airflow path 103 having the bleed valve 200 may be any part of the airflow passageway between the dirty air inlet 102 and the clean air outlet 104 and may be upstream of the suction motor 126 and downstream of a pre-motor filter.

As exemplified in FIGS. 4 to 9, the bleed valve 200 includes one arcuate spring member 220. The spring member 220 is located in chamber 208 between the air inlet 210 and the air outlet 212. The spring member is mounted in the housing so as to close the air inlet 210. For example, as exemplified, the spring member 220 may extend from a first end 205 to a second end wall 205.

Figure 6:
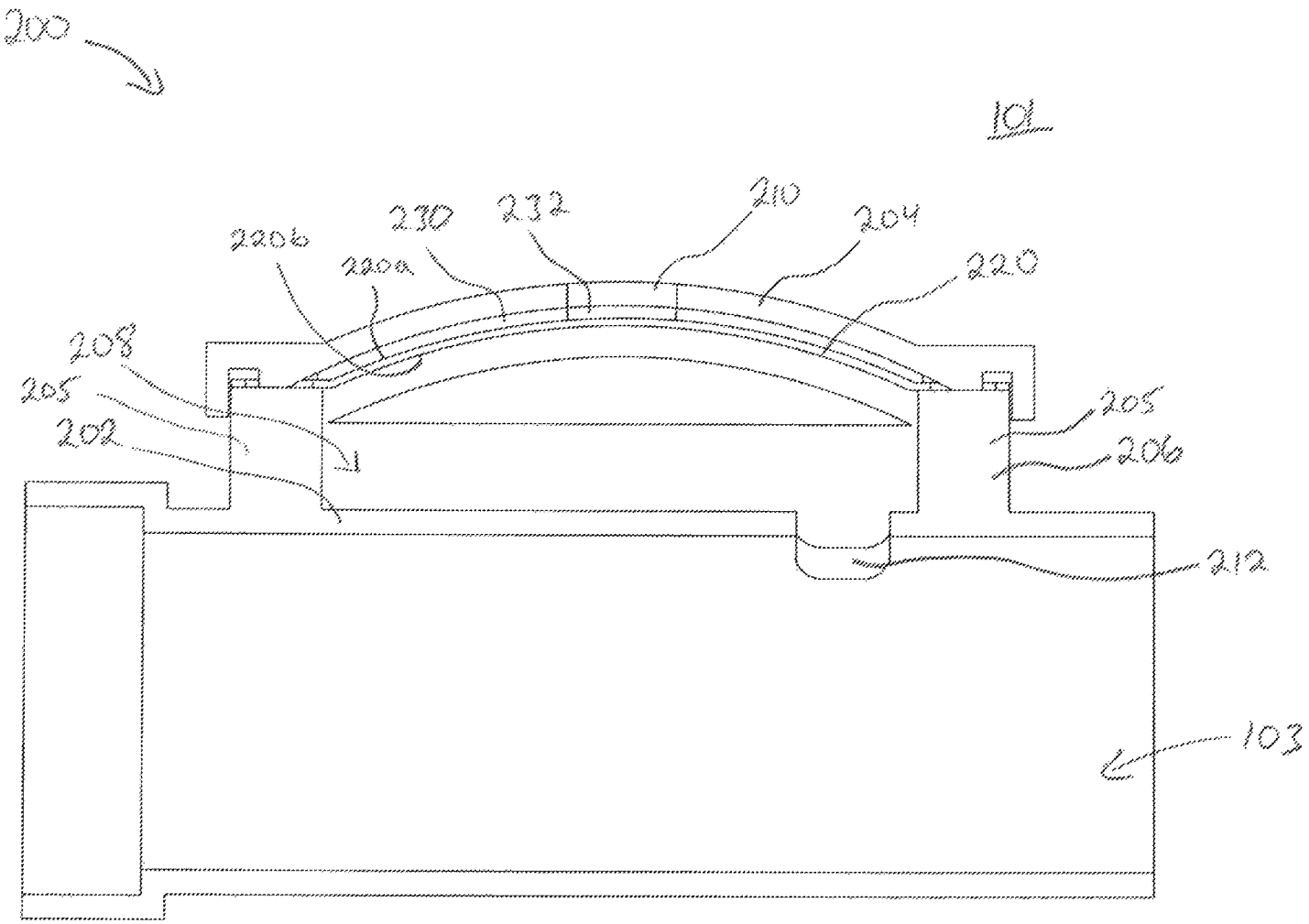
FIG. 6 is a side sectional view of the bleed valve of FIG. 4 with the bleed valve in a closed position.
Figure 7:
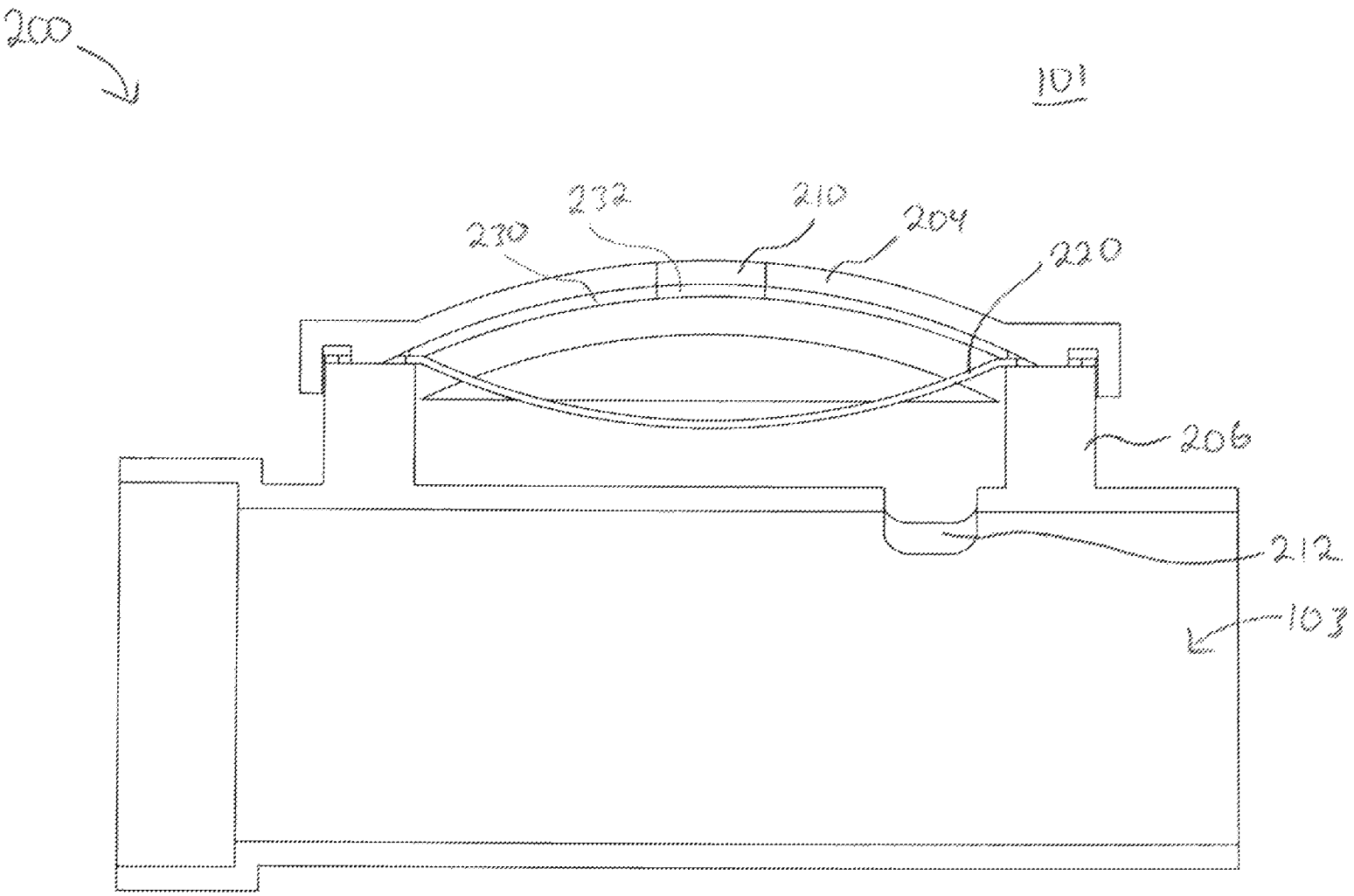
FIG. 7 is a side sectional view of the bleed valve of FIG. 4 with the bleed valve in an open position.

As the spring member is arcuate, the arcuate spring member 220 is positionable only in a closed arcuate configuration (see FIG. 6) and an open arcuate configuration (see FIG. 7). In other words, in such embodiments, the arcuate spring member 220 does not have an intermediary position. During use, the arcuate spring member 220 switches between the open arcuate position and the closed arcuate position due to a pressure differential to which the outer surface 220*a* and the inner surface 220*b* of the spring member 220 are exposed. As such, the arcuate spring member 220 may snap between the open arcuate position and the closed arcuate position. Accordingly, the bleed valve 200 will open automatically when the pressure in the suction motor housing 122 upstream of the suction motor decreases to a predetermined level creating a predetermined pressure differential to which the outer surface 220*a* and the inner surface 220*b* of the spring member 220 are exposed.

In the embodiment of FIGS. 4-9, the spring member 200 is preformed into an arcuate configuration. It will be appreciated that the entire spring member 220 may be arcuate, or, as exemplified, the spring member 220 may have an arcuate region 222 located between two non-arcuate portions. The spring member 220 may be secured in the bleed valve housing using any means known in the art. As exemplified, arcuate region 222 is located between end members, which are referred to as first connection region 224 and second connection region 226 and are used to secure the spring member 220 to the bleed valve housing. In the exemplified embodiment, spring member 220 is secured in position by a plurality of screws 201 that are used to secure the outer wall 204 in position. Accordingly, outer wall 204 is provided with a plurality of openings 204*a*, end walls are provided with a plurality of openings 205*a* and each end region is provided with one or more openings 224*a* and 226*a*. When aligned, a screw 201 may be inserted through opening 204, opening 224*a* and secured in opening 205*a*. It will be appreciated that any mechanical fastener may be used and that alternately, or in addition, the housing mat be secured together by, e.g., an adhesive, welding or the like. Alternately, or in addition, the connection regions may merely be sandwiched between the outer wall 204 and the end walls 205 as exemplified in the embodiment of FIGS. 16-19.

It will also be appreciated that connection regions 224 and 226 may be any shape that can be secured to the bleed valve housing. For example, the connection regions 224 and 226 may be planar, as exemplified in FIG. 5.

It will also be appreciated that the spring member 220 need not be secured in position by the mechanism used to secure the outer wall 204 in position. For example, the spring member 220 may be secured in position by an alternate mechanical fastener.

Optionally, the bleed valve 200 may include a seal 230 located between the outer surface 220*a* of the spring member and an inner surface of the outer wall 204. For example, the seal 230 may be provided on the outer wall 204 or on the spring member 220 or, as exemplified in FIG. 5, it may be a separate member. The seal 230 includes an opening 232 that is aligned with the air inlet 210. In some embodiments, the seal 230 may be coupled to the housing in a similar manner as spring member 220. Accordingly, the seal 230 may have openings 230*a* that align with the openings 204*a* of the outer wall 204.

As exemplified, when the spring member 220 is installed in the bleed valve housing, the spring member 220 is oriented such that the arcuate region 222 is oriented to abut the inner surface of outer wall 204 and, as such, is biased to the closed configuration when installed in the bleed valve housing.

Figure 8:
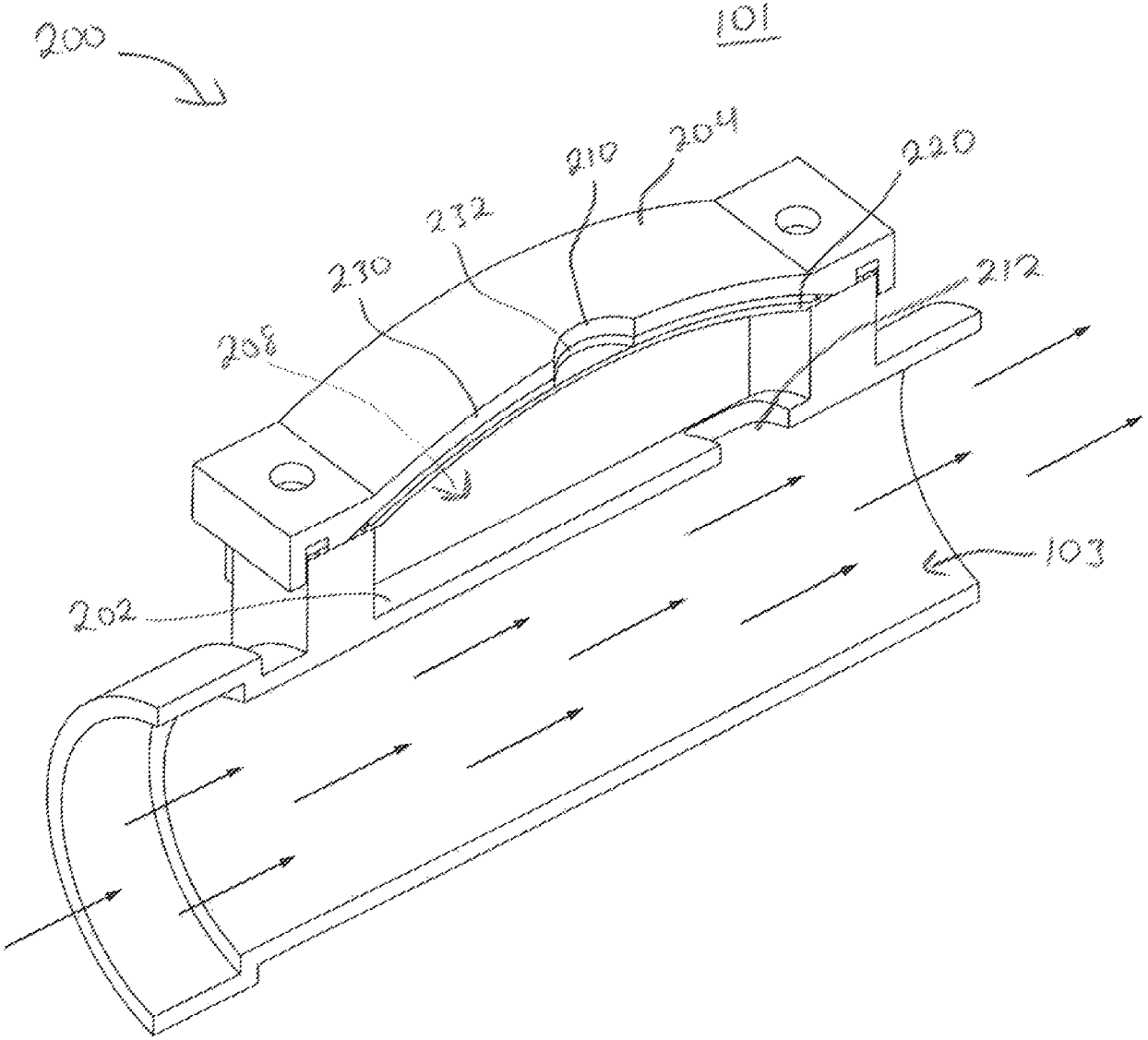
FIG. 8 is a perspective sectional view of the bleed valve of FIG. 4 with the bleed valve in a closed position and typical air flow passing through an air flow path.

In the closed arcuate configuration, the arcuate spring member 220 overlies or covers or abuts the opening 232 in the seal 230. By covering the opening 232 in the seal 230, the air inlet 210 is also covered. When covering the air inlet 210, the arcuate spring member 220 prevents airflow through the airflow passageway 214. For example, FIGS. 6 and 8 show the arcuate spring member 220 in the closed arcuate configuration. When the bleed valve 200 is in the closed arcuate position, as exemplified in FIGS. 2 and 8, air flows through the surface cleaning head 106 into the cyclone chamber 150. Air then flows from the cyclone chamber 150 into the suction motor housing 122 and through the suction motor 126. Air then exits the suction motor 126 through the clean air outlet 104.

Figure 9:
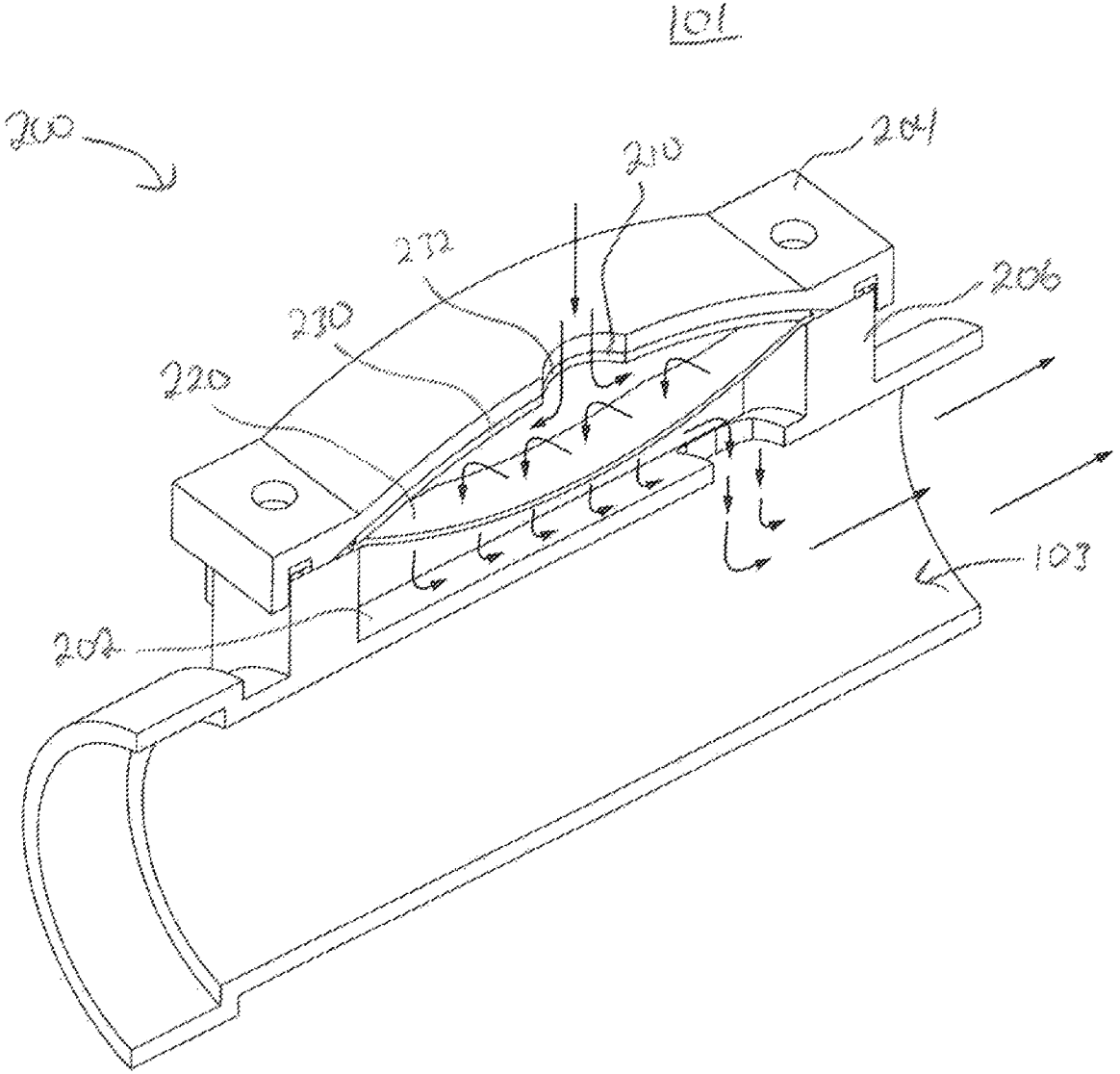
FIG. 9 is a side sectional view of the bleed valve of FIG. 4 with the bleed valve in an open position and typical air flow passing through the bleed valve.

When the pressure differential between chamber 208 and the ambient 101 exterior to chamber 208 overcomes the biasing force, the spring member 220 moves to the open configuration. When in the open arcuate position, the air inlet 210 is not covered as the arcuate spring member 220 has moved to an arcuate configuration in which it is spaced away from the air inlet 210. For example, FIGS. 7 and 9 show the arcuate spring member 220 in the open arcuate configuration. Referring now to FIGS. 3 and 9, shown therein is an illustration of the airflow in the surface cleaning apparatus 100 when the bleed valve 200 is in the open arcuate configuration. Air flows from the location 101 exterior to the airflow path through the bleed air inlet 210. Air flows through the airflow passageway 214, out the bleed air outlet 212 into the suction motor housing 122 (a location 103 interior to the airflow path). Air then flows from the suction motor housing 122 through the suction motor 126 and out the clean air outlet 104.

It will be appreciated that the bleed valve 200 may selectively open and close the bleed air inlet 210 due to a pressure differential between the interior 103 of the airflow path at a location of the bleed air inlet 210 and the location 101 exterior to the airflow path. For example, when the air flow path 103 is clogged (e.g. with an object or a dirty filter), air flow from the dirty air inlet 102 into the suction motor 126 is reduced. The suction motor 126 will continue to dispel air from the surface cleaning apparatus 100, reducing the pressure in the suction motor housing 122. As the pressure in the suction motor housing 122 (the location 103 interior to the airflow path) decreases, a pressure differential is formed between the location 101 exterior to the airflow path and the location 103 interior of the airflow path. Eventually, the pressure differential may be great enough to overcome a spring force of the arcuate spring member 220. When the spring force is overcome, the arcuate spring member 220 will snap away from the opening 232 in the seal 230, so that air may flow from the air inlet 210, through the airflow passageway 214, and out the air outlet 212.

Thus, the arcuate spring member 220 is operable between a closed configuration in which the arcuate spring member 220 is in a closed arcuate configuration and abuts the air inlet 210, and an open arcuate configuration in which the arcuate spring member 220 is in an open arcuate configuration and is spaced from the air inlet 210.

When the bleed valve opens, a user may turn of the apparatus 100 and remove the blockage (e.g., clean or replace the filter or remove an object blocking the air flow path 103). When the apparatus 100 is turned off, the pressure in the suction motor housing 122 increases, and the pressure differential on the spring member 220 is removed or reduced. When the pressure differential can no longer overcome the spring force of the arcuate spring member 220, the arcuate spring member 220 will snap back to the seal 230, covering the opening 232 and covering the air inlet 210, thereby returning to its closed arcuate configuration.

Figure 10:
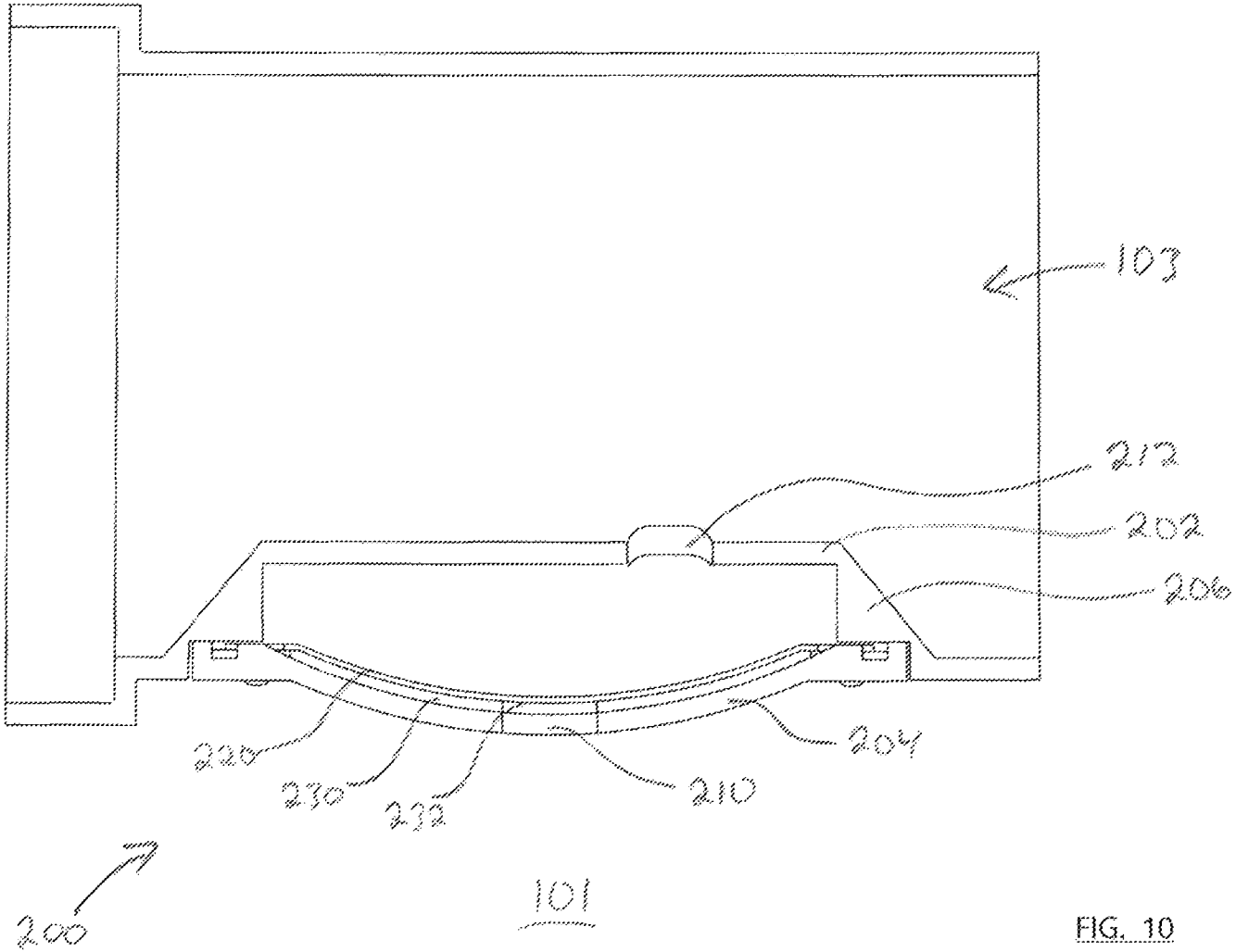
FIG. 10 is a side sectional view of a bleed valve in accordance with another embodiment with the bleed valve in a closed position.
Figure 11:
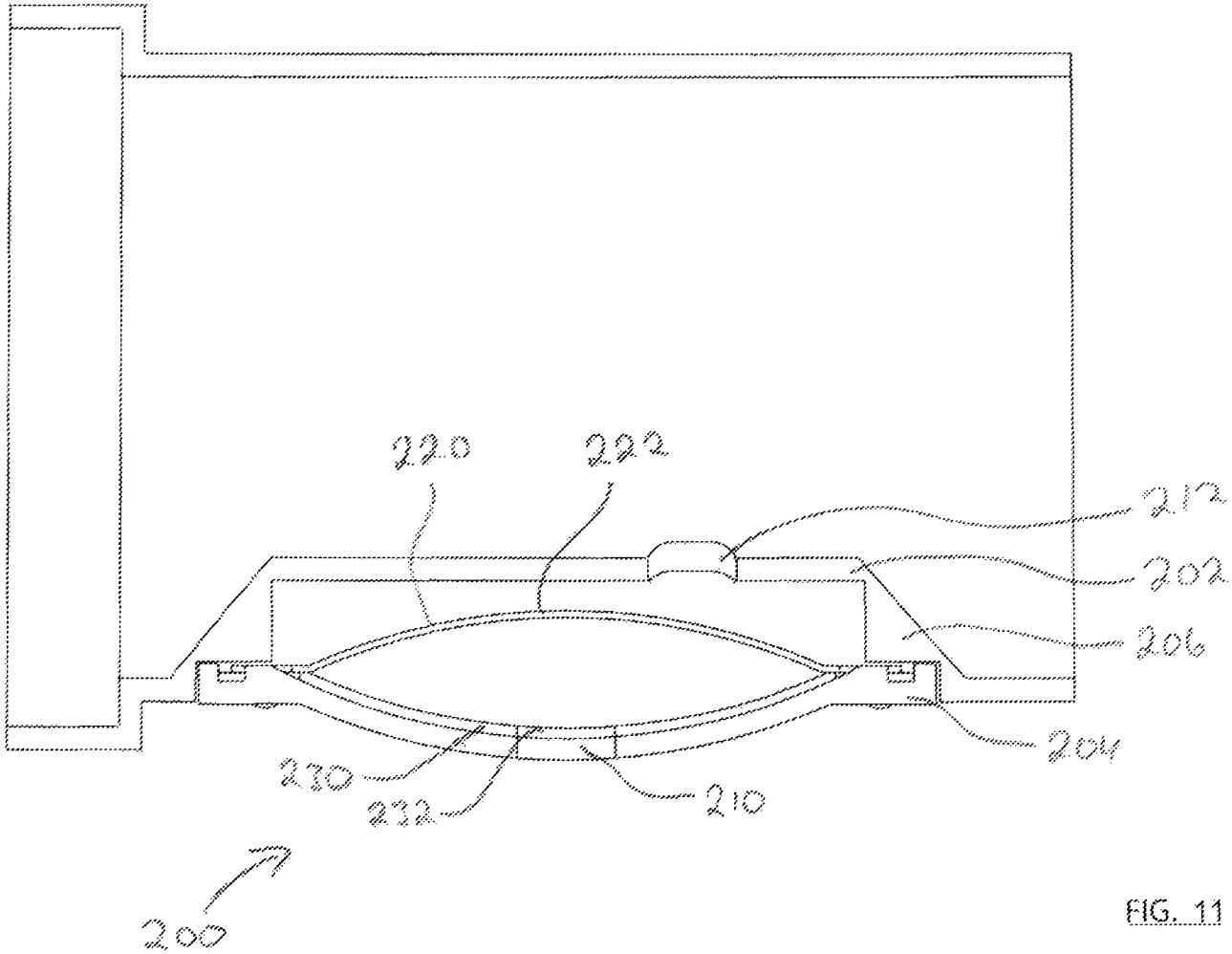
FIG. 11 is a side sectional view of the bleed valve of FIG. 10 with the bleed valve in an open position.

In some embodiments, the bleed valve may be recessed such that it does not extend beyond the sidewall of the surface cleaning apparatus 100. For example, FIGS. 10 and 11 illustrate a bleed valve 200 with a recessed bleed valve housing. The recessed housing may assist in protecting the bleed valve 200 from damage.

In some embodiments, the spring member 220 is not pre-shaped to have an arcuate region shape. Instead, as exemplified in FIGS. 12 to 15, the spring member 220 may be, e.g., planar or flat, and the arcuate shape may be created by the spring member 220 being shaped or deformed upon installation into the bleed valve housing. For example, the portions of the end walls 205 and the outer wall 204 which spring member abuts may be configured to produce an arcuate shape. For example, the portions of the end walls 205 and the outer wall 204 that the spring member 220 abuts may be angled upwardly towards the center of the bleed valve housing, thereby causing the spring member 220 to be configured to the closed arcuate configuration. Alternately, the length of the spring member in a direction of air flow through the passage 103 may be longer than the length of the bleed valve chamber 208 in the direction of air flow through the passage 103. Accordingly, when installed in the bleed valve housing, the spring member may be forced into the closed arcuate configuration.

It will be appreciated that spring member 220 of this embodiment operates in the same manner as the arcuate spring member 220 of the embodiment of FIGS. 4-9.

Regardless of whether the spring member 200 is pre-formed into an arcuate shape, in some embodiments, the bleed valve may have an inner end stop for limiting the extent to which the spring member 220 extends inwardly when in open configuration. For example, as exemplified in FIGS. 16 to 19, bleed valve 200 is provided with an end stop 540. In this embodiment, the bleed valve 200 has a spring member 220 that is pre-shaped into an arcuate shape and biased to its closed arcuate configuration, similar to the spring member 220 of the embodiment of FIGS. 4-9. The end stop 540 provides a limit for the motion of the spring member 220 when the spring member 220 moves from the closed configuration to the open configuration. By limiting the motion of the spring member 220, the end stop 540 may help prevent the spring member 220 from wearing out during use or from moving too far into an open arcuate position such that the spring member 220 will not snap back to the closed arcuate configuration.

It will be appreciated that the end stop 540 may be of various configurations and may be secured in position by any means. As exemplified, the end stop 540 has first connection region 542 and second connection region 546 with an abutment portion 544 located therebetween. First connection region 542 and second connection region 546 may be sandwiched between ends walls 205 and the outer wall 204 as previously discussed. In addition, they may be provided with openings so that a mechanical securing member, e.g., screw 201, may pass therethrough. End stop 540 may have the same shape as spring member 220. Alternately, it may be of any shape or configuration that provides an end limit position for the spring member 220 in the open configuration.

It will be appreciated that spring member 220 may be of various shapes provided it has a portion that closes inlet 210 in the closed arcuate configuration. As exemplified in FIG. 5, spring member 220 has a general contiguous shape from one end to the other (it widens gradually towards the center). Alternately, as exemplified in FIG. 17, spring member 200 has narrow arm members 248 that extend between connecting regions 224, 226 and central abutment region 250.

In some embodiments, the bleed valve may have a plurality of arcuate spring members overlying each other. For example, the bleed valve may have two arcuate spring members that abut each other. The first arcuate spring member may behave in a similar manner to the arcuate spring member 220 described above. The first arcuate spring member may be operable between a closed arcuate configuration in which the first arcuate spring member abuts the air inlet and an open arcuate configuration in which the first arcuate spring member is spaced away from the air inlet.

A second arcuate spring member may provide additional support (closure force) for the first arcuate spring member. For example, during operation, a single spring member may flutter due to minor changes in pressure in the surface cleaning apparatus 100. Flutter in the spring member may intermittently allow air through the bleed valve. Intermittent airflow may reduce the suction force provided by the suction motor 126 at the dirty air inlet 102 and interrupt cyclonic flow in a cyclone chamber. Adding a second spring member to support the first spring member may reduce the flutter of the first spring member. In other words, pressure differentials across the bleed valve that are insufficient to drive the valve to the open position may not result in the bleed valve fluttering. When the pressure differential becomes great enough (e.g. there is a clog in the surface cleaning apparatus 100), both the spring force of the first arcuate spring member and the spring force of the second arcuate spring member will be overcome, and the bleed valve (the first and second spring members) will snap to the open arcuate configuration.

An advantage of this design is that thinner spring members 220 may be used.

Description of Cantilevered Bleed Valve Embodiments

In another aspect, as exemplified in FIGS. 20 to 27, the bleed valve may have a cantilevered spring member that selectively opens and closes a bleed valve air inlet. The cantilevered spring member may be operable between a closed configuration in which the cantilevered spring member abuts the bleed air inlet and an open arcuate configuration in which the spring member is in a curved configuration and is spaced from the bleed air inlet.

FIGS. 20 and 21 exemplify a bleed valve 200 having a cantilevered spring member 220. The cantilevered spring member 220 selectively opens and closes an air inlet 210 due to a pressure differential between the interior of the airflow path 103 at a location of the bleed air inlet and the location 101 exterior to the airflow path. The bleed valve 200 has an airflow passageway 214 extending from the air inlet 210 to an air outlet 212. A coupling member, such as a screw 201 couples the cantilevered spring member 220 to an inner wall 202. The inner wall 202 may be a wall of the surface cleaning apparatus 100.

Optionally, as with the arcuate spring member 220 exemplified in FIGS. 4-19, a sealing member 230 may be provided to overlie the air inlet 210 when the spring member 220 is in the closed configuration. For example, as illustrated in FIGS. 20 and 21, sealing member 230 provided between the cantilevered spring member 220 and the wall 202. As exemplified in FIGS. 20 and 21, the sealing member is provided on inner surface 202. The sealing member 230 may be coupled to the inner wall 202, surrounding the air inlet 210 by any means, such as mechanical fastening members or an adhesive.

As with the arcuate spring member 220 exemplified in FIGS. 4-19, during normal operation, the suction motor 126 induces airflow through the dirty air inlet 102 and out the clean air outlet 104. If the airflow path becomes clogged (as described previously), the air pressure in air flow path 103 is reduced and the reduced pressure creates a pressure differential across the bleed valve 200, between the location 101 exterior to the airflow path and a location interior to the airflow path 103. When the pressure differential becomes great enough, the cantilevered spring member 220 moves from its closed configuration to its open arcuate configuration. In its open arcuate configuration, the cantilevered spring member 220 has an arcuate region 622 that is spaced away from the air inlet 610. In the open arcuate configuration, air flows from the location 101 exterior to the airflow path, through the bleed valve 200, and into the airflow path 103. When a user shuts the apparatus 100 off to clear the clog, the pressure differential reduced and the cantilevered spring member 220 moves to its closed planar configuration.

In some embodiments, the sealing member may be provided on the cantilevered spring member. For example, as illustrated in FIGS. 22 and 23, a bleed valve 200 has a sealing member 230 provided on the inner surface of the cantilevered spring member 220. For example, it may be secured thereto by an adhesive, welding or mechanical fastening members. Alternately, as exemplified in FIGS. 24 and 25, sealing member 230 encases the cantilevered spring member 220 (e.g., sealing member may have an opening in which part or all of spring member 200 is received).

Optionally, a sealing member 230 may be provided on the bleed valve housing and also on the spring member 200.

In some embodiments, the bleed valve 220 may have a plurality of cantilevered spring members. In some embodiments, as exemplified in FIGS. 26 and 27, the bleed valve may have at least a first and a second abutting cantilevered spring members. As shown therein, the bleed valve 200 includes the first cantilevered spring member 220 and a second cantilevered spring member 920. The first and second cantilevered spring members 220 and 920 may be coupled to the surface cleaning apparatus 100 with the same coupling member 201, or each may be secured by a different coupling member.

Each of the first cantilevered spring member 220 and the second cantilevered spring member 920 are operable between a closed configuration and an open arcuate configuration. In the open arcuate configuration, the first cantilevered spring member 220 has a curved, or arcuate, region 622. In the closed configuration, the first spring member 220 abuts the air inlet 210. In the open arcuate configuration, the second cantilevered spring member 920 is also spaced from the air inlet 210 and may also have an arcuate section.

The first cantilevered spring member 220 and a second cantilevered spring member 920 may have the same length. Alternately, as exemplified, they may have different lengths. Optionally, as exemplified the inner spring member 920 is shorter than the outer spring member 220.

In some embodiments, a sealing member 230 may be provided on the first cantilevered spring member 220 and/or on the wall 202.

As discussed previously, the second spring member 920 may reduce flutter and improve the function of the surface cleaning apparatus 100.

While the above description provides examples of the embodiments, it will be appreciated that some features and/or functions of the described embodiments are susceptible to modification without departing from the spirit and principles of operation of the described embodiments.

Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising an arcuate spring member operable between a closed configuration in which the spring member is in a closed arcuate configuration and abuts the opening, and an open arcuate configuration in which the spring member is in an open arcuate configuration and is spaced from the opening.

2. The surface cleaning apparatus of claim 1 wherein the arcuate spring member is positionable in only the closed arcuate configuration and the open arcuate configuration.

3. The surface cleaning apparatus of claim 1 wherein the arcuate spring member is biased to the closed arcuate configuration.

4. The surface cleaning apparatus of claim 1 wherein the arcuate spring member is positioned interior to the bleed air inlet.

5. The surface cleaning apparatus of claim 1 wherein the arcuate spring member is provided in a bleed valve housing and the arcuate spring member is in the closed arcuate configuration prior to being installed in the bleed valve housing.

6. The surface cleaning apparatus of claim 1 wherein the arcuate spring member is pre-formed in an arcuate shape.

7. The surface cleaning apparatus of claim 1 wherein the arcuate spring member is provided in a bleed valve housing and the bleed valve housing deforms the arcuate spring member into the closed arcuate configuration.

8. The surface cleaning apparatus of claim 1 wherein the bleed air inlet comprises a bleed valve chamber extending between the opening and the airflow path and the arcuate spring member is located in the bleed valve chamber.

9. The surface cleaning apparatus of claim 1 wherein the wall is an outer wall of the airflow path and the arcuate spring member is located in the airflow path.

10. The surface cleaning apparatus of claim 1 wherein the bleed valve comprises a plurality of arcuate spring members overlying each other.

11. The surface cleaning apparatus of claim 10 wherein the bleed valve comprises two arcuate spring members that abut each other.

12. The surface cleaning apparatus of claim 1 further comprising a sealing member located between the arcuate spring member and the wall when the arcuate spring member is in the closed arcuate configuration.

13. A surface cleaning apparatus comprising:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising at least first and second abutting cantilevered spring members operable between a closed configuration in which the first spring member abuts the opening, and an open arcuate configuration in which the first and second spring members are in a curved configuration and are spaced from the opening.

14. The surface cleaning apparatus of claim 13 wherein, in the closed configuration, the spring members are generally planar.

15. The surface cleaning apparatus of claim 13 wherein the second spring member is located on an inner side of the first spring member and is shorter than the first spring member.

16. The surface cleaning apparatus of claim 13 further comprising a sealing member located between the first spring member and the wall when the first spring member is in the closed configuration.

17. The surface cleaning apparatus of claim 16 wherein the sealing member is provided on an inner surface of the wall.

18. The surface cleaning apparatus of claim 16 wherein the sealing member is provided on the first spring member.

19. The surface cleaning apparatus of claim 16 wherein the sealing member encases at least a portion of the first spring member.

20. A surface cleaning apparatus comprising:

(a) an airflow path extending from a dirty air inlet to a clean air outlet, the airflow path having an interior and a direction of flow;

(b) an air treatment member and a fan and motor assembly provided in the airflow path;

(c) the airflow path having a bleed air inlet, the bleed air inlet extending between a location exterior to the airflow path and the interior of the airflow path, the bleed air inlet comprising an opening in a wall of the apparatus; and, (d) a bleed valve selectively opening and closing the bleed air inlet due to a pressure differential between the interior of the airflow path at a location of the bleed air inlet and the location exterior to the airflow path, the bleed valve comprising a cantilevered spring member operable between a closed configuration in which the spring member abuts the opening, and an open arcuate configuration in which the spring member is in a curved configuration and is spaced from the opening, wherein a sealing member encases at least a portion of the spring member.

* * * * *